US006095372A

United States Patent [19]

Dorsey et al.

[11] Patent Number: 6,095,372

[45] Date of Patent: Aug. 1, 2000

[54] BEVERAGE DISPENSER CABINET AND HOLDER

[75] Inventors: Steven T. Dorsey, St. Joseph; Jerome D. Powlas, Maple Grove; Karl D. Johnson, Rogers, all of Minn.

[73] Assignee: Stevens-Lee Company, Plymouth, Minn.

[21] Appl. No.: 09/344,839

[22] Filed: Jun. 28, 1999

Related U.S. Application Data

[62] Division of application No. 08/853,446, May 9, 1997, Pat. No. 5,938,078.

[51] Int. Cl.[7] ..... B65D 35/56

[52] U.S. Cl. ..... 222/105; 222/146.6; 222/183; 222/185.1; 222/517; 222/529

[58] Field of Search ..... 222/105, 146.6, 222/183, 185.1, 513, 517, 529, 531, 537

[56] References Cited

U.S. PATENT DOCUMENTS

| | | | |
|---|---|---|---|
| D. 30,815 | 5/1899 | Hart, Jr. | D12/120 |
| D. 30,817 | 5/1899 | Hart, Jr. | D12/120 |
| D. 30,818 | 5/1899 | Hart, Jr. | D12/120 |
| D. 31,479 | 8/1899 | Hart, Jr. | D12/120 |
| D. 31,480 | 8/1899 | Hart, Jr. | D12/115 |
| D. 137,129 | 1/1944 | O'Connell et al. | D7/619 |
| D. 143,238 | 12/1945 | Pfefferkorn | D8/306 |
| D. 175,159 | 7/1955 | Dunkle | D7/620 |
| D. 178,846 | 9/1956 | Norris | D7/307 |
| D. 183,854 | 11/1958 | Moody | D7/622 |
| D. 184,673 | 5/1959 | Frasure | D7/622 |
| D. 215,328 | 9/1969 | Fera | D7/622 |
| D. 270,029 | 8/1983 | McClean | D7/622 |
| D. 282,617 | 2/1986 | Hogan | D7/308 |
| D. 347,347 | 5/1994 | Erdman | D7/308 |

(List continued on next page.)

OTHER PUBLICATIONS

"Silver King Presents The New UK Line of Refrigerated Milk Dispensers," Silver King Division of Stevens Lee Company, Form SK/UK, 4 pp. (published prior to May 17, 1996).

"Nor–Lake Presents . . . Fineline Milk Dispensers," Nor–Lake Inc., Form MD85, 4 pp. (published prior to May 17, 1996).

"Savings You Can See," Parish Manufacturing, Inc., 4 pp. (published prior to May 17, 1996).

"Use instructions for Liqui–Box 'Versakase,' " Liqui–Box Corporation, 1 pp. (published prior to May 17, 1996).

"Silver King Refrigerated Milk Dispensers—Royal Special Series," Silver King, Division of Stevens Lee Company, Form #2186, 1986, 2 pp.

Magazine photo of Heinz–labelled, wall–mounted bulk ketchup dispenser (from a bag of ketchup), manufacturer unknown, magazine unknown, but published prior to May 17, 1996, 1 p.

(List continued on next page.)

*Primary Examiner*—Joseph A. Kaufman
*Attorney, Agent, or Firm*—Kinney & Lange, P.A.

[57] ABSTRACT

A beverage dispenser, usable in dispensing milk, has a large refrigerated cabinet for housing large beverage containers. The beverage dispenser has a handle/valve with a first closed position, a second open position, and a third position for insertion and removal of a flexible milk tube. The handle includes two arms, and the user holds a cup between the two arms to receive the dispensed milk. The valve includes a cooling plate which refrigerates the milk in the flexible milk tube extending through the valve. The valve has a pinch plate which closes the flexible tube with a rocking motion, initially pinching the flexible tube at its lowest point and subsequently reopening the tube slightly to suck any beverage drops on the end of the tube back up into the tube. A hinged shelf is provided for ease of loading and unloading milk cases in and out of the refrigerated cabinet. The milk case has angled hand hold openings to allow lifting without repositioning of the wrists. The milk case is specially made to receive a connector from a milk bag, and includes a tie which raises the flexible milk tube prior to insertion of the flexible tube into the valve. A secondary shut-off mechanism is on the inside of the cabinet to shut off flow control by the handle.

18 Claims, 16 Drawing Sheets

U.S. PATENT DOCUMENTS

| | | | |
|---|---|---|---|
| 2,197,958 | 4/1940 | Waters | 221/23 |
| 2,831,610 | 4/1958 | Dennie et al. | 222/183 |
| 2,861,718 | 11/1958 | Winzen | 222/107 |
| 2,936,068 | 5/1960 | Munkacay | 206/46 |
| 2,944,700 | 7/1960 | Stevenson | 220/85 |
| 2,999,714 | 9/1961 | Ritchie | D7/394 |
| 3,024,943 | 3/1962 | Yeager | 220/85 |
| 3,171,573 | 3/1965 | Berney | 222/183 |
| 3,191,810 | 6/1965 | Johnston | 222/183 |
| 3,212,681 | 10/1965 | Wiekert | 222/185.1 |
| 3,246,825 | 4/1966 | Zastrow | 222/183 |
| 3,250,562 | 5/1966 | Frasure | 294/31.2 |
| 3,297,206 | 1/1967 | Scholle | 222/105 |
| 3,363,807 | 1/1968 | Powell | 222/183 |
| 3,532,255 | 10/1970 | Norris et al. | 222/146.6 |
| 3,539,081 | 11/1970 | Norton et al. | 222/517 |
| 3,638,834 | 2/1972 | Goodrich et al. | 222/105 |
| 3,871,559 | 3/1975 | Smith et al. | 222/183 |
| 3,908,864 | 9/1975 | Capper | 222/105 |
| 3,940,018 | 2/1976 | Scholle | 222/185 |
| 4,032,047 | 6/1977 | Wilson | 222/183 |
| 4,349,121 | 9/1982 | Lafferty | 220/341 |
| 4,440,319 | 4/1984 | Nitchman et al. | 222/183 |
| 4,690,307 | 9/1987 | Hogan | 222/95 |
| 4,907,723 | 3/1990 | Katz | 222/105 |
| 5,163,587 | 11/1992 | Apps et al. | 222/105 |
| 5,249,510 | 10/1993 | Rozak et al. | 99/336 |
| 5,301,601 | 4/1994 | Cretors | 99/323.5 |
| 5,344,048 | 9/1994 | Bonerb | 222/105 |
| 5,356,029 | 10/1994 | Hogan | 220/465 |
| 5,377,876 | 1/1995 | Smernoff | 222/183 |
| 5,462,168 | 10/1995 | Oberhelman et al. | 222/183 |
| 5,862,856 | 1/1999 | Brandenburg et al. | 222/183 |

OTHER PUBLICATIONS

"Silver King Refrigerated Milk Dispensers/Imperial Series," Silver King, a Division of Stevens Lee Company, Form #2286, 1989 Jan. 1996, 4 pp.

"Silver King Refrigerated Milk Dispensers/Compact Series," Silver King, a Division of Stevens Lee Company, Form #2386, 1986, 2 pp.

"Silver King Milk Dispenser Accessories," Silver King, a Division of Stevens Lee Company, Form 2486, 2 pp. (published prior to May 17, 1996).

"Norris Super Line Milk Dispensers," Norris Dispenser Company, Form No. N395, 2 pp. (published prior to May 17, 1996).

"Norris Manhattan Line Milk Dispensers," Norris Dispenser Company, Form No. N295, 2 pp. (published prior to May 17, 1996).

"NSF Certified Norris Manhattan NS Line Milk Dispensers," Norris Dispenser Company, Form No. N195, 2 pp. (published prior to May 17, 1996).

"Nor–Lake Presents . . . Now You Have A Choice!," Nor–Lake Inc., Form No. MD08$^2$, 2 pp. (published prior to May 17, 1996).

"APW/WYOTT—Dispensers & Pumps," Price Sheet, p. 17. (published prior to May 17, 1996).

"Replacement Parts—Milk Dispenser Valve Holders and Valves," Silver King, a Division of Stevens Lee Company, Form 99587 Jun. 1994.

Milk Holder, Family Circle Magazine, p.21, Feb. 1958 (D7/622).

BEVERAGE DISPENSER CABINET AND HOLDER

This application is a divisional of U.S. patent application Ser. No. 08/853,446, filed May 9, 1997 now U.S. Pat. No. 5,938,078.

BACKGROUND OF THE INVENTION

The present application relates to liquid dispensers, and more particularly, to beverage dispensers used to dispense refrigerated liquids such as milk from a large container through a flexible tube.

Beverage dispensers such as milk dispensers have existed for many years for institutional use. The term "institution", as used herein, refers to any entity that will ordinarily supply and maintain the beverage dispenser. The institutions may be cafeterias, restaurants, food services, communal kitchens, or individual residences.

Milk dispensers traditionally include a refrigerated cabinet in which large containers such as cans or bags of milk can be housed for dispensing. In the United States, dispenser cans of milk are commonly available in three and five gallon sizes, and bags of milk are commonly available in three, five and six gallon sizes. The cans may be refilled or reused, while the bags are typically single service. The bags are flexible plastic such as polyethylene, and are usually placed in a structurally supporting milk case for dispensing. The term "milk case", as used herein, refers to any structure for supporting a flexible beverage container. The plastic of the baas is usually clear so that the institution can see how much milk remains in the bag. The cans and bags are typically selected and filled by dairies or homogenization plants. The term "container", as used herein, refers to any type of beverage container positioned in the cabinet to be dispensed by the beverage dispenser, including the described cans and bags as well as other containers. Single, double and triple dispensers accommodating one, two or three containers, respectively, are common.

The containers are made with a flexible tube extending from the main body of the container. For instance, the flexible tube may be formed of an fairly inert rubber. The material of the flexible tube typically has some resiliency to spring back to a circular cross-sectional shape after being pinched. The flexible tube is initially sealed at its distal end. When it is desired to use a container, an employee places the container into the refrigerated cabinet, and inserts the tube through an opening adjacent the base of the refrigerated cabinet. The tube which then extends to the outside of the cabinet is cut or otherwise opened by the employee so milk will flow out of the cabinet through the tube. The term "employee", as used herein, refers to the person who supplies, maintains and cleans the beverage dispenser, regardless of the relationship of the "employee" to the "institution". The term "user", as used herein, refers to the person ho fills a cup, glass, pitcher or similar serving receptacle by dispensing beverage out of the beverage dispenser. For instance, in certain circumstances the "institution", the "employee" and the "user" may be the same person, such as the owner of a small restaurant who works there and pours him or herself a glass of milk.

A valve is disposed in the opening of the cabinet to close the tube or to allow the tube to spring back open. In most milk dispensers in use today, the valve is actuated by a weighted lever or handle. The weight of the handle, through a mechanical advantage, normally pinches the flexible tube shut. When a user lifts up on the weighted lever, the valve is opened and milk flows through the tube into a cup or glass positioned underneath the tube by the user.

The prior milk dispenser designs are simple and cost effective to manufacture. This type of prior milk dispenser has been produced for decades with little change in its operation and design, and the prior milk dispenser design has obtained a significant market penetration. Prior milk dispensers are well liked by both users and institutional employees. The prior milk dispensers are easy to use, and regular institutional customers are familiar with operation of the machines. The prior milk dispensers are easy to supply, easy to maintain and reliable, and employees are familiar with loading, unloading and cleaning procedures.

The National Sanitary Foundation ("NSF") issues regulations for the handling of dairy beverages such as milk which must be met by beverage dispenser manufacturers. In the most recent NSF regulations, milk should be handled at a temperature between 32° F. and 40° F. until dispensing.

A number of improvements can be made to the prior milk dispenser design to provide for a more effective and efficient beverage dispenser. As importantly, many of these improvements can be made without drastically altering the prior operation, loading, unloading and maintenance procedures to which the market has become accustomed, and those familiar with the prior art milk dispensers can readily switch to the milk dispenser of the present invention without substantial instruction.

SUMMARY OF THE INVENTION

The present invention is a beverage dispenser, particularly intended for dispensing milk, but which can also be used to dispense other liquids. A three position handle/valve is provided with a first closed position,a second open position, and a third position for insertion and removal of the flexible tube. The handle/valve provides maximum ergonomic benefit and ample manufacturing flexibility. The valve includes a cooling plate which refrigerates the milk in the flexible tube extending through the valve. The pinch plate for the valve incorporates a rocking motion which initially pinches the flexible tube at its lowest point and subsequently reopens the tube slightly to suck any milk drops on the end of the tube back up into the refrigerated portion of the tube. The handle includes two arms, and the user holds a cup between the two arms to receive the dispensed milk. A hinged shelf is provided for ease of loading and unloading milk cases. The preferred milk case has angled hand hold openings to allow lifting without repositioning of the wrists. The milk case is easy to load and includes a tie which raises the flexible milk tube prior to insertion of the flexible tube into the valve. The milk dispenser also has a pinch mechanism on the inside of the cabinet to shut off milk flow control by the handle such as for extended shut-off periods.

Figure 1:
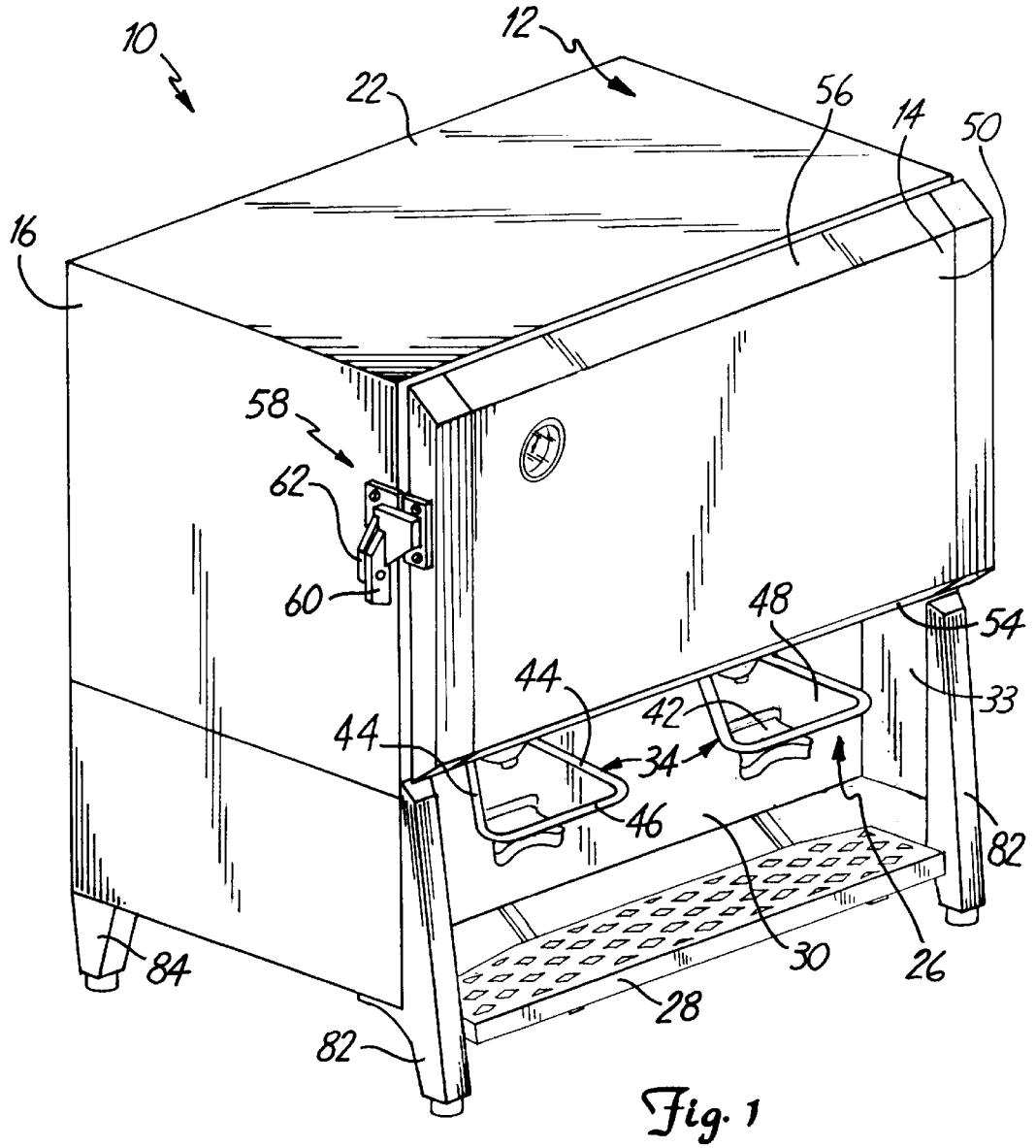
FIG. 1 is a perspective view of a double milk dispenser unit according to the present invention.
Figure 2:
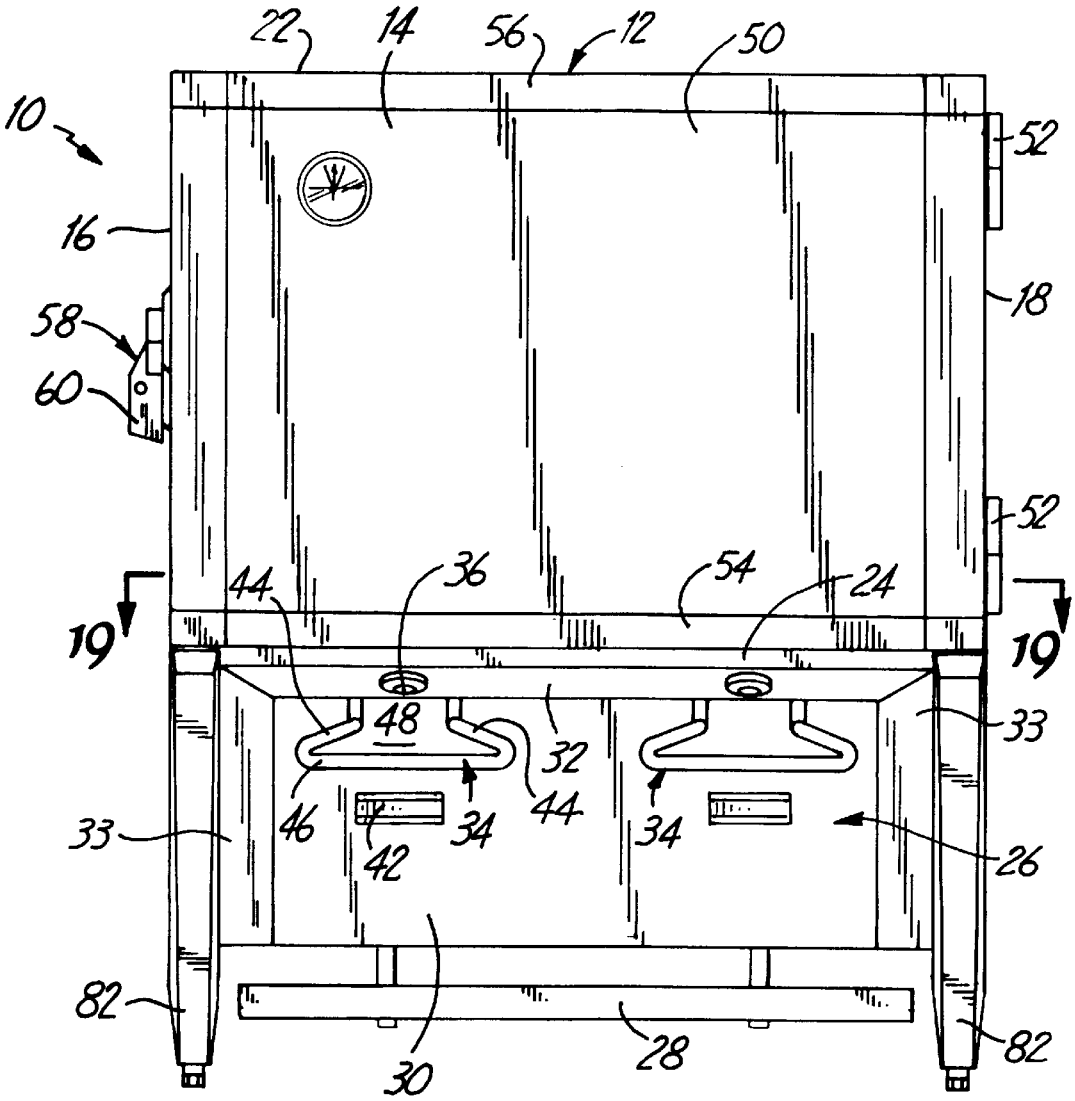
FIG. 2 is a front elevational view of the milk dispenser of FIG. 1.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION OF THE PREFERRED EMBODIMENT

FIGS. 1–4 show outside views of the beverage dispenser 10 of the present invention. The beverage dispenser 10 can be used to dispense a wide variety of liquids, but is particularly designed and intended to refrigerate and dispense milk. The milk dispenser 10 includes a cabinet 12 with a front wall 14, a left side wall 16, a right side wall 18, a back wall 20, a top wall 22 and a bottom wall 24. Preferably both the inner and outer surface of the cabinet 12 are of stainless steel for stain resistance, ease of cleaning and appearance.

The front wall 14 preferably includes a lower recess or dispenser section 26 where beverage dispensing takes place. The dispenser section 26 is defined by a drain plate 28 on the bottom, a splash plate or apron 30 on the back a valve splash guard 32 on the top, and side walls 33. The drain plate 28 provides the user with a surface upon which to place a cup if desired. The drain plate 28 preferably includes a large number of openings to allow any large spills to drain through the drain plate 28. The apron 30 and the valve splash guard 32 are preferably continuous sheets of stainless steel. The valve splash guard 32 is preferably disposed at a slight angle to horizontal, such that the dispenser section 26 is taller toward the front than toward the back. The drain plate 28, the apron 30 and the valve splash guard 32 are preferably readily removable from the mill, dispenser 10 for ease of thorough cleaning.

Two levers or handles 34 are provided on the front wall 14 of the cabinet 12. The handles 34 preferably extend forward from the valve splash guard 32. A valve opening 36 is positioned in the valve splash guard 32 associated with each of the handles 34. During use, a flexible tube 38 from a large beverage container 40 (shown in FIGS. 5, 10–12, 18 and 20–22) extends through the valve opening 36. A glass stop 42 is positioned on the apron 30 immediately behind each of the valve openings 36. The glass stop 42 includes an arc which is preferably sized to receive a standard 8 ounce drinking cup or a standard 12 ounce drinking cup (not shown) such as are commonly used in institutions. The glass stop 42 is used to position the glass or cup to receive milk out of the valve opening 36. To use the beverage dispenser 10, a user positions a cup on the glass stop 42 and pushes or pivots the handle 34 upward. Pivoting of the handle 34 causes milk to be dispensed out of the flexible tube 38 at the valve opening 36.

The beverage dispenser 10 shown is a "double" unit, allowing simultaneous dispensing liquid from two containers 40. Workers skilled in the art will appreciate that the present invention is equally applicable to "single" units as well as to multiple units having more than two dispensing locations.

Each handle 34 preferably includes two arms 44 and a cross bar 46 which define an opening 48. In this embodiment, the opening 48 defined by the arms 44 and the cross bar 46 has a trapezoidal shape. Milk is dispensed downward from the valve opening 36 and between the trapezoidally-shaped opening 48. The trapezoidally-shaped opening 48 thus also serves as an indication to the user of the location to place the cup to receive milk. Workers skilled in the art will appreciate that the opening defined by the handle could have a variety of shapes and still indicate to the user the location to place the cup to receive milk.

The cross bar 46 allows a user to raise the handle 34 with a single arm While holding a cup in his or her hand against the glass stop 42. The preferred cross bar 46 has a length of about 6¾ inches. The width of the preferred handle 34 provided by the length of the cross bar 46 allows a user to raise the handle 34 with his or her arm extending somewhat to the side, such as when the user is not standing directly in front of the milk dispenser 10. The two arms 44 of the handle 34 lead to a well balanced structure with a smooth pivoting motion (without rocking) even if the force placed on the handle 34 is not well centered. Preferably the handle 34 is formed of a bent stainless steel bar, which provides both strength for the handle 34 and cleaning and appearance benefits necessary for a part which is touched by numerous users in a food environment.

A door 50 is included as part of the front wall 14 of the cabinet 12. The door 50 provides access to the interior of the cabinet 12. While the door 50 could be located on other sides 16, 18, 20, 22, 24 of the cabinet 12, placement of the door 50 on the front wall 14 allows easy access to the interior of the cabinet 12 for loading and unloading of containers 40. Preferably the door 50 is insulated, such as with foam insulation injected between inner and outer sheets of stainless steel.

In the preferred embodiment, hinges 52 are included to pivotally mount the door 50 to the right side wall 18 of the cabinet 12. With this hinge position, the door 50 swings clear to permit open access to the valve opening 36 on the inside of the cabinet 12. However, workers skilled in the art will appreciate that hinges could alternatively be placed at other locations to pivotally mount the door 50 at any desired orientation. For instance, hinges could be placed on the bottom of the door 50, with the door 50 when opened being held horizontally flat and doubling as a shelf for insertion of the containers 40 into the cabinet 12.

A front lower edge 54 of the door 50 is angled or beveled to permit better viewing of discharge of beverage from the valve opening 36. The line of sight to the valve opening 36 is important to the user for proper placement of the cup underneath the valve opening 36 to avoid spills. This line of sight may also be important for the employee who cuts the flexible tube 38 extending through the valve opening 36, allowing the employee to cut the flexible tube 38 closer to the valve opening 36. The flexible tube 38 may be cut with the door 50 either open or shut. In either case, it is important that the employee cut the flexible tubing close to the valve opening 36 to obtain the full benefits of the present invention. A front upper edge 56 of the door 50 may also be angled or beveled to provide a pleasing symmetrical appearance.

A latch 58 for the door 50 is provided on the unhinged side of the door 50. Such latches are well known in the art. The latch 58 includes a latch handle 60 on the door 50 which mates with a latch base 62 on the cabinet 12. The latch handle 60 is retained in a closed position such as by a spring to keep the door 50 shut. The latch handle 60 pivots, and raising of the latch handle 60 unlatches the door 50 from the left side wall 16 of the cabinet 12. The latch handle 60 and the latch base 62 preferably include aligned holes for insertion of a locking mechanism such as a padlock (not shown).

Particularly for use in dispensing milk, the cabinet 12 is preferably refrigerated. The refrigeration unit can be a standard refrigeration unit as well known in the art. The left side wall 16, the right side wall 18, the back wall 20 and the top wall 22 each include a condenser and/or evaporator coil 64, a portion of which is shown in the broken away section of FIG. 3. Preferably the walls 16, 18, 20, 22 include inner and outer shells of stainless steel, with foam insulation injected between the inner and outer shells to fill the space around the condenser/evaporator coil 64. The refrigeration unit preferably includes a temperature sensing bulb (not shown) and a temperature control device 66 (shown in a broken away portion of FIG. 5) so that the temperature for the refrigeration cabinet 12 can be selected as desired by the institution. The preferred refrigerant is R134A, and the refrigerant operates at about 10 to 15° F. to maintain the interior of the cabinet 12 at 32 to 41° F. and preferably at 32 to 37° F.

As with previous beverage dispensers, the beverage dispenser 10 is intended for use on a counter top, such that the container 40 is at a height of about three to four feet above the floor. The beverage dispenser 10 may also bepositioned a significant distance such as from about 1 to 2½ feet from the edge of the counter. For instance, the beverage dispenser 10 may be positioned on a counter behind a rail conveyor for cafeteria trays. The containers 40 used in the beverage dispenser 10 may weigh from 25 to 60 pounds. Beverage dispensers must be designed with some clearance between the container and the inside of the cabinet to allow insertion of the container into the cabinet.

The positioning of beverage dispensers relative to the counter edge, together with the heavy weight of the containers, has lead to difficulties in loading prior beverage dispensers. These difficulties are exacerbated by the wide variety of different employees (short, tall, old, young, strong, weak) who may be called on to supply the beverage dispenser. The employee must lift the container above the counter and then extend his or her arms to position the container into the cabinet. Lifting a heavy weight and holding the heavy weight an extended distance of 1 to 2½ feet may be impossible for some employees, and may cause injury to other employees. The container must be aligned with the door opening in the cabinet prior to insertion of the container into the cabinet. In prior art designs, the employee must perform the alignment While holding the heavy weight of the container. With a small clearance between the walls of the prior cabinet and the container, a corner of the container may not be aligned with the door opening and may bump into a wall of the cabinet, causing further difficulty in loading the container into the cabinet, or even causing damage to the container. If the container is not properly held, supported and or aligned, the employees fingers may get pinched between the prior cabinet and the container, causing a painful injury and perhaps dropping of the container.

Figure 4:
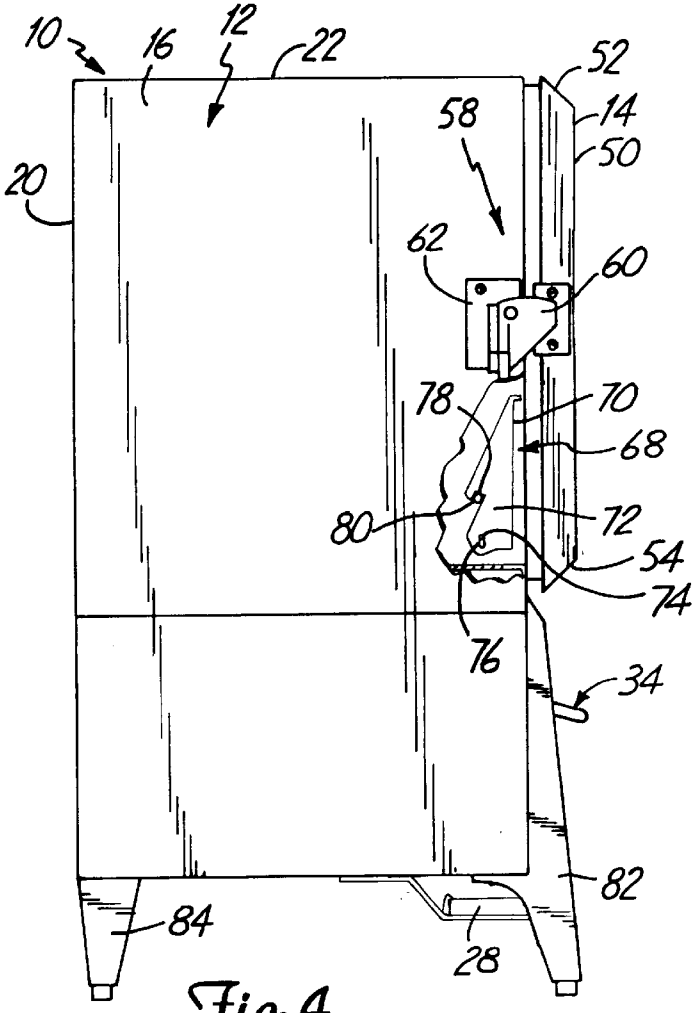
FIG. 4 is a side elevational view of the other side of the milk dispenser of FIG. 1, with a portion broken away to show the pivoting shelf.
Figure 5:
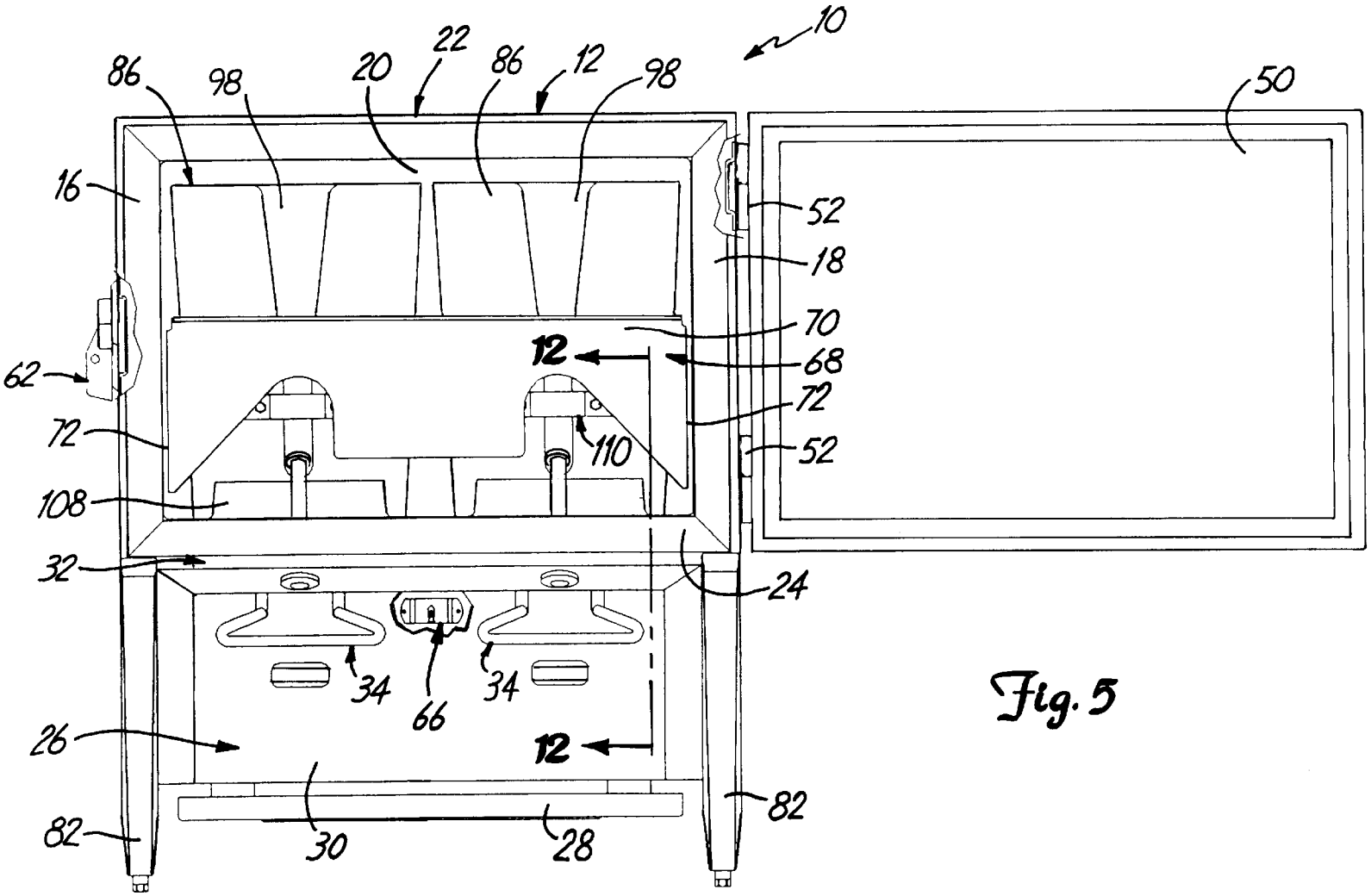
FIG. 5 is a front elevational view of the milk dispenser of FIG. 1 with the cabinet door open to show the milk cases.
Figure 11:
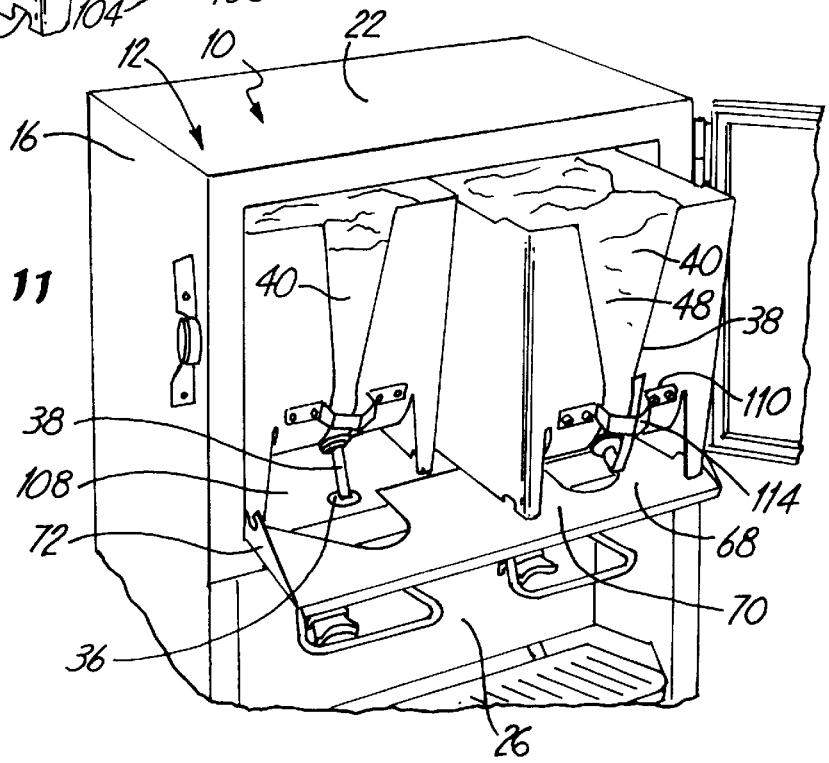
FIG. 11 is a perspective view showing loading of the milk dispenser of FIG. 1.

As best shown in FIGS. 4, 5 and 11, the beverage dispenser 10 of the present invention preferably includes a pivoting shelf 68 in the interior of the cabinet 12 immediately behind the door 50. The shelf 68 includes a support surface 70 and two shelf flanges 72. Each shelf flange 72 is connected at an end of the support surface 70 and extends normal to the support surface 70. The shelf 68 may be formed of a bent sheet of stainless steel. The generally triangular shape of the flanges 72 helps to strengthen the shelf 68 and generally maintain the support surface 70 in a planar configuration, to reduce bowing of the support surface 70 under the weight of a full container 40.

Two coaxially aligned pivot pins 74 are provided, one extending inwardly from the bottom front corner of each of the right side wall 18 and the left side wall 16. Each of the shelf flanges 72 has an elongated slot 76, for hinged connection to one of the pivot pins 74. The hinged connection provided by the pivot pins 74 allows pivoting of the shelf 68 between the upright position shows in FIGS. 4 and 5 and the extended position shown in FIG. 11. The elongated slots 76 allow the shelf 68 in its upright position to be raised slightly, such as about ½ of an inch, with respect to the pivot pins 74. The pivot pins 74 are preferably made out of steel, and need to be strong enough to support the cantilevered weight of two full containers 40 sitting on the support surface 70 of the shelf 68. The pivot pins 74 are preferably removable from the side walls 16, 18, to facilitate cleaning of the pivot pins 74 and the shelf 68 outside the cabinet as well as cleaning of the interior of the cabinet 12 without interference from the pivot pins 74 and the shelf 68.

The shelf flanges 72 each include a knob receiving recess 78. Two knobs 80 are provided, one extending inwardly from the front of each of the right side wall 18 and the left side wall 16 of the cabinet 12. The knobs 80 are spaced from the pivot pins 74 and sized relative to the knob receiving recesses 78 to mate with the knob receiving recesses 7S. The knobs 80 are received in the knob receiving recesses 78 to hold the shelf 68 in the upright position of FIGS. 4 and 5.

When desired, the shelf 68 can be raised slightly upward on the pivot pins 74 to remove the knobs 80 from the recesses 78. With the knobs 80 out of the recesses 78, the shelf 68 can be pivoted about the pivot pins 74 downward into the generally horizontal, extended position of FIG. 11. The shelf 68 is maintained in this extended position by resting on the front edge of the bottom wall 24 of the cabinet 12.

The removably extending shelf 68 is of great benefit when loading the beverage dispenser 10 with a new container 40. The shelf 68 allows the container 40 to be supported prior to insertion of the container 40 into the cabinet 12. The employee loading the beverage dispenser 10 is not required to hold the heavy weight of the container 40 in a position extended outward from his or her body.

Placing the container 40 on the shelf 68 automatically aliens the container 40 square relative to the cabinet 12 prior to insertion of the container 40 into the dispenser 10. The container 40 is merely slid into position in the dispenser 10, without worry about alignment of the container 40 relative to the cabinet 12, and without having to perform the alignment while holding the weight of the container 40. Problems associated with contact between a corner of the container 40 and the cabinet walls 16, 18 are avoided. Problems associated with pinching of the employees fingers between the container 40 and the cabinet walls 16, 18 while performing the alignment are similarly avoided. Without alignment problems, the cabinet 12 can be designed to have a smaller clearance and a tighter fit around the container 40, leading to minimal dead air space in the cabinet 12 to be cooled by the refrigeration unit.

Workers skilled in the art will appreciate that other mounting arrangements will allow the shelf to be removably positioned in the extended position. For instance, the shelf could be mounted similar to a drawer, for horizontal sliding (rather than pivoting) relative to the cabinet 12. With a sliding shelf, the containers 40 would remain on the shelf both in the extend position and the retracted position. Horizontal sliding of the shelf requires all of the flexible tubes 38 to be removed from their respective valve openings 36. Accordingly, a sliding shelf is particularly applicable for a single container unit. which will never require changing of less than all the containers on the sliding shelf. For multiple container units, different sliding shelves should be provided for each container.

As another equivalent alternative, shelf 68 may have an additional center flange(s) between positions of the containers 40. A mounting bracket(s) may be mounted in the cabinet for the center flange(s), to provide the pivot pin and knob for each center flange. Such additional center flange(s) provide additional strength, which may be necessary due to the width of the multiple unit beverage dispenser 10.

Figure 3:
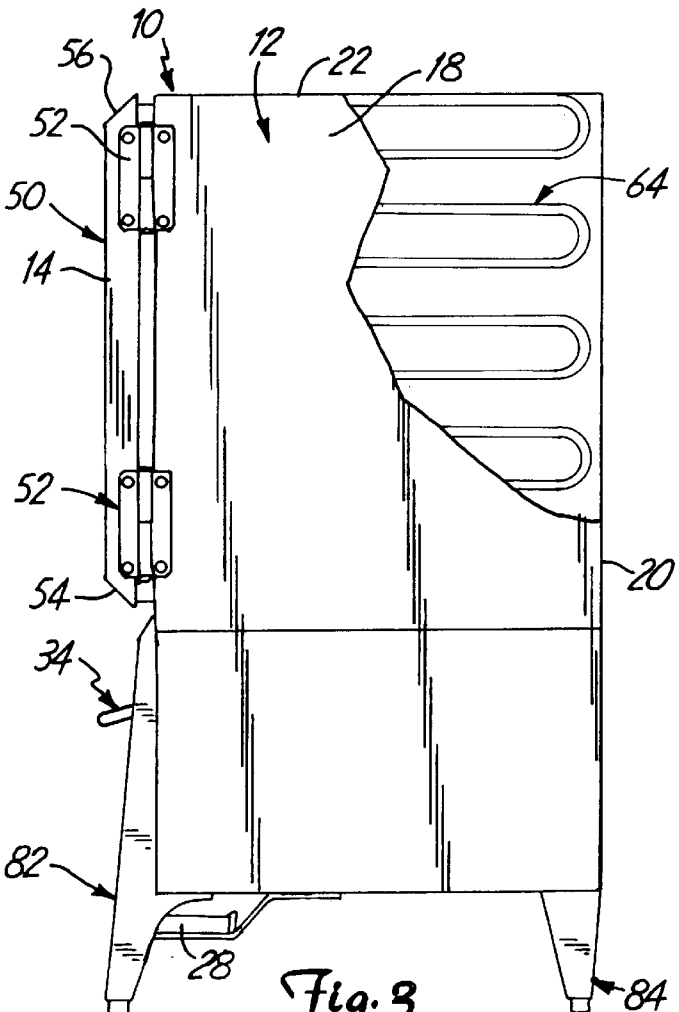
FIG. 3 is a side elevational view of the milk dispenser of FIG. 1 with a portion broken away to show the refrigerating condenser/evaporator coil.

The beverage dispenser 10 preferably includes two front legs 82 and two rear legs 84. As best seen in FIGS. 3 and 4, the front legs 82 extend forwardly beyond the front wall 14 of the cabinet 12. This forward position allows the containers 40 to be placed on the extended shelf 68 without tipping of the beverage dispenser 10.

FIG. 5 shows the milk dispenser 10 with the front door 50 open, with two milk cases 86 shown in the cabinet 12. Each milk case 86 is for holding a flexible bag 40 of milk (shown in FIG. 11, and for properly orienting the bag 40 of milk with respect to the valve opening 36. If the beverage to be dispensed is provided in a rigid container, such as a can or box rather than the flexible bag 40, the beverage dispenser 10 may be used without the milk cases 86.

FIGS. 6–10 show the milk case 86 more clearly. Each milk case 86 includes a front wall 88, right and left side walls 90, and a back wall 92, each of which extend generally upright, and a generally horizontal bottom wall 94. The top of the milk case 86 is left open for loading and unloading of the bag 40. If desired, the top of the milk case 86 may alternatively be closed by a wall or a door, and/or one of the sides 88, 90, 92 of the milk case 86 may alternatively include a door. The preferred milk case 86 is approximately 13 inches tall, 10 inches wide, and 13 inches deep, and can receive any of 3, 5 and 6 gallon bags.

Figure 8:
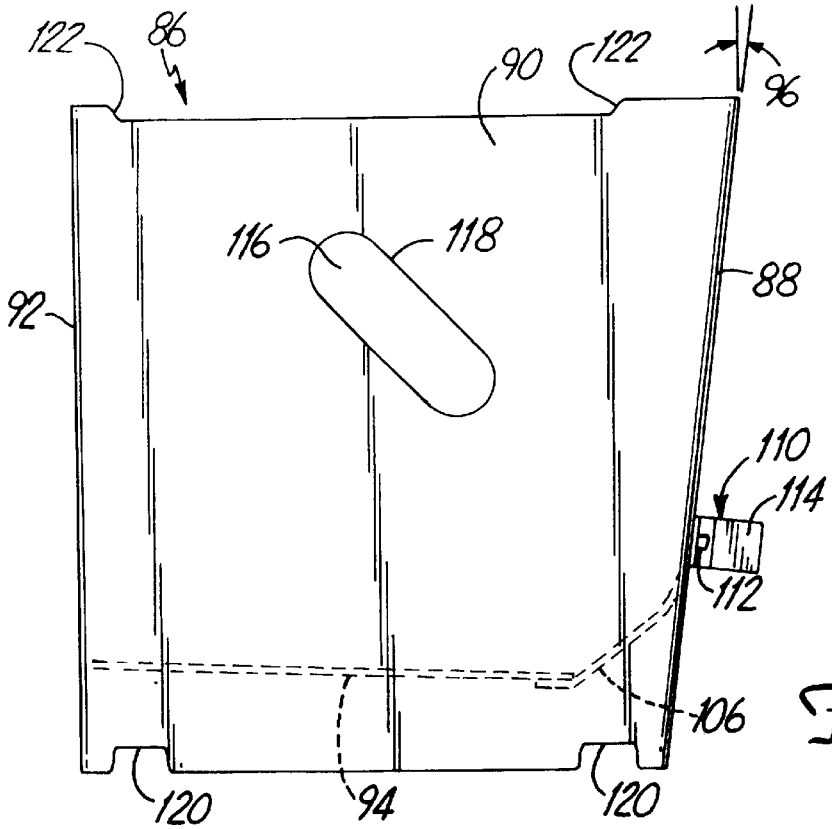
FIG. 8 is a side elevational view of the milk case of FIG. 6.
Figure 9:
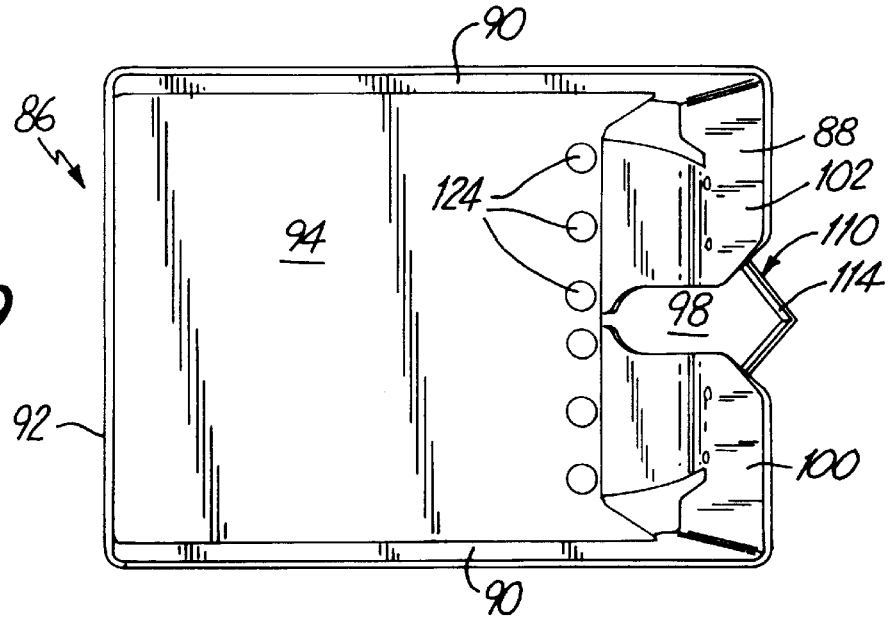
FIG. 9 is a top plan view of the milk case of FIG. 6.

As shown in FIG. 8, the front wall 88 slants slightly to the vertical as shown by an angle 96. Preferably this angle 96 is from about 3 to 15°. The front wall 88 of the milk case 86 includes an opening 98 defined between a left portion 100 and a right portion 102. The opening 98 is wider at the top and includes a taper on the upper portion of the front wall 88. Lower on the front wall 88 the opening 98 has a constant width. The preferred opening 98 is at least 2 inches and most preferably about 4 inches wide at the top.

The opening 98 is for receiving a connector 104 of a milk bag 40. The tapered upper portion of the opening 98 allows the milk bag 40 to be placed into the case 86 with the connector 104 extending through the wide portion of the opening 98 but without requiring complete alignment of the milk bag 40 relative to the opening 98. After the milk bag 40 is set in the case 86 in this general orientation, the milk bag 40 may then be moved or turned such that the connector 104 travels downwardly within the opening 98. The tapered upper portion of the opening 98 helps to completely align the milk bag 40 during this downward movement for positioning the connector 104 within the lower portion of the opening 98. The constant width bottom portion of opening 98 should be about 1 to 1½ inches wide and sized to mate with the connector 104.

The angle 96 of the front wall 88 to vertical creates gravitational assistance in inserting the connector 104 through the opening 98. When the bag 40 of milk is placed in the case 86, gravity forces the milk in the bag 40 against the front wall 88. The gravitational pressure force against the front wall 88 proves to be very helpful in aligning the connector 104 relative to the opening 98, and loading of a bag 40 of milk in a case 86 with a slanted front wall 88 is much easier than loading of a bag 40 of milk in a case 86 with a vertical front wall.

As best shown in FIG. 8, the bottom wall 94 is positioned upward from the bottom edge of the side walls 90. Accordingly, the bottom portions of the side walls 90 act as legs to suspend the bottom wall 94 upwardly in the cabinet 12. In the preferred embodiment, the bottom wall 94 is raised about 2 inches above the bottom edge of the side walls 90. The bottom wall 94 slants slightly such that the lower most portion of the milk bag 40 in the milk case 86 is at the front bottom corner 106. The front wall 88 curves at the front bottom corner 106.

When the case 86 is loaded, the milk bag connector 104 is inserted into the opening 98 all the way down to the bottom corner 106. The curvature of the bottom corner 106 causes rotation of the milk bag 40 into the most opportune position for emptying the entirety of the milk bag 40. This orientation of the milk bag 40 places the flexible tube 38 at a position where it points downwardly. As shown with the left milk case 86 of FIG. 11, placement of the milk case 86 into the cabinet 12 positions the flexible tube 38 immediately adjacent the valve opening 36 for a straight shot downward through the valve opening 36.

Raising the bottom corner 106 of the milk case 86 above the bottom edge of the side walls 90 provides a free space 108 (FIGS. 6 and 11) between the connector 104 of the milk bag 40 and the valve opening 36. The employee can use this free space 108 for the manipulation necessary to insert the flexible tube 38 through the valve opening 36. Once inserted, the free space 108 allows the flexible tube 38 to extend through the valve opening 36 without linking even if the opening 98 of the milk case 86 is slightly out of alignment with the valve opening 36.

The straight downward orientation of the connector 104 and flexible tube 38 and the non-kinking of the flexible tube 38 is particularly important in complete emptying of the milk bag 40 at a high rate of flow. Without the orientation and non-kinking benefits of the present invention, the flow rate in prior milk dispensers may become too slow even with a substantial amount of milk left in the bag 40. A slow flow rate may cause an employee to change containers 40 prematurely, wasting the remaining milk left in the container 40. The present invention thus helps to avoid wasting of the beverage by providing a high flow rate until the container 40 is completely empty.

After the milk bag 40 is properly positioned and in use, the opening 98 allows an employee to visually check the amount of milk left in the bag 40. The employee merely opens the door 50 and looks through the opening 98 at the milk bag 40. Checking the amount of milk left in the bag 40 can accordingly be accomplished without lifting or moving of the milk case 86 or the mill, bag 40. Similarly, the opening 98 allows the employee to reach into the milk case 86 and readjust the milk bag 40 without moving the milk case 86. Such readjustment may be performed to ensure that the milk bag 40 is fully emptied prior to replacement.

A tie 110 is attached to both the left portion 100 and the right portion 102 of the front wall 88 such as by bolts 112. The tie 110 extends across the opening 98 in the front wall 88 and helps to structurally strengthen the milk case 86. The preferred tie 110 is a bent strip of about 1 inch wide, 1/8th inch thick stainless steel.

Figure 10:
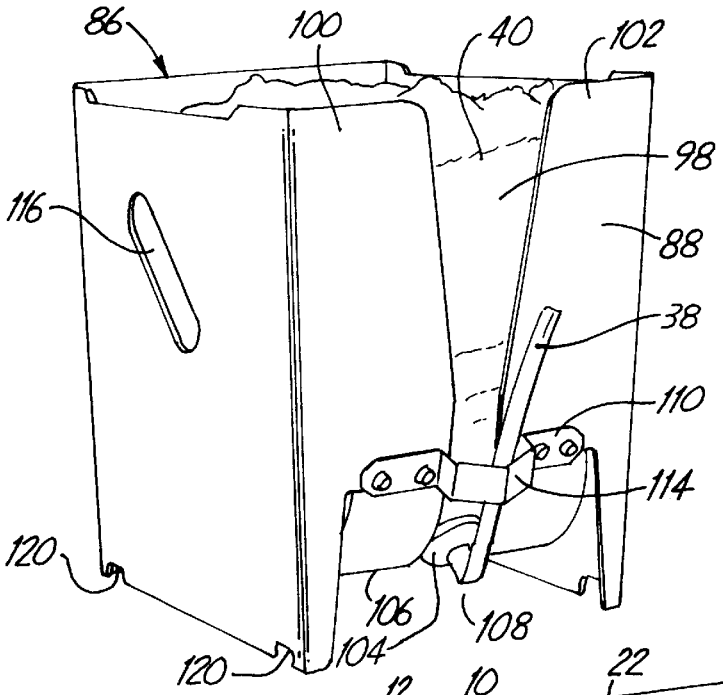
FIG. 10 is a perspective view showing a milk bag with a flexible tube in the milk case of FIG. 6.

The tie 110 includes a forwardly extending V-portion 114. The V-portion 114 extends forwardly sufficient to allow the connector 104 of the milk bag 40 to travel up and down in the opening 98 behind the tie 110. As shown in FIGS. 10 and 11, this V-portion 114 also helps to raise and center the flexible milk tube 38 when the bag 40 is inserted into the case 86. In many institutional environments, the milk case 86 may be place on the floor during loading with a new milk bag 40. Raising of the flexible milk tube 38 via tie 110 keeps the tube 38 from contacting the floor during loading, and keeps any germs or dirt from the floor off of the flexible tube 38.

Each side wall 90 includes a hand-hold opening 116 which provides a hand-hold edge 118. The hand-hold opening 116 is slanted, with the hand-hold edge 118 extending forwardly and downwardly. The preferred slant places the hand-hold edge 118 at an angle of about 45° to the vertical. The hand-hold openings 116 should be centered from front to back in the side walls 90 so there is no moment force associated with lifting the milk case 86 with the hand-hold openings 116. The hand-hold openings 116 are preferably rounded so as not to present any sharp corners in use. The preferred hand-hold openings 116 are about 5 inches long and 1½ to 2 inches wide.

Horizontal or vertical hand-hold edges of prior art milk cases place the employees' wrists at awkward angles during lifting the heavy weight of a milk case with a full milk bag from the floor to the cabinet when the cabinet is on a counter. In comparison, the slant of the hand-hold edge 118 of the present invention provides considerable ergonomic benefit. The slant provides a hand-hold edge 118 which has a substantial vertical component, which is helpful in holding the milk case 86 at arms height. The slant also provides a hand-hold edge 118 which has a substantial horizontal component, which is helpful in lifting the milk case 86 off the floor and in spreading the weight of the milk case 86 across the employee's hand.

Figure 6:
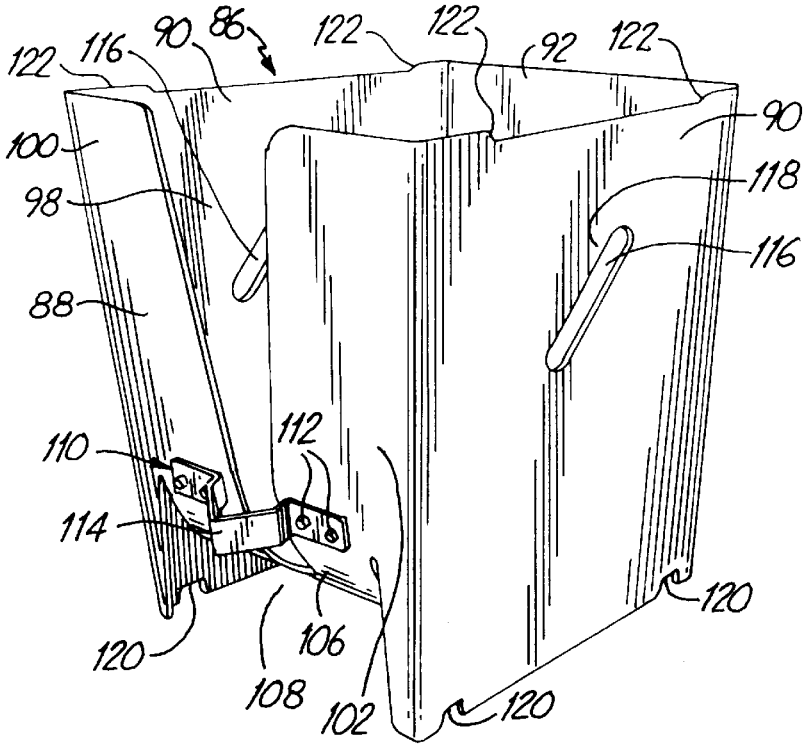
FIG. 6 is a perspective view of the milk case of FIG. 5.
Figure 7:
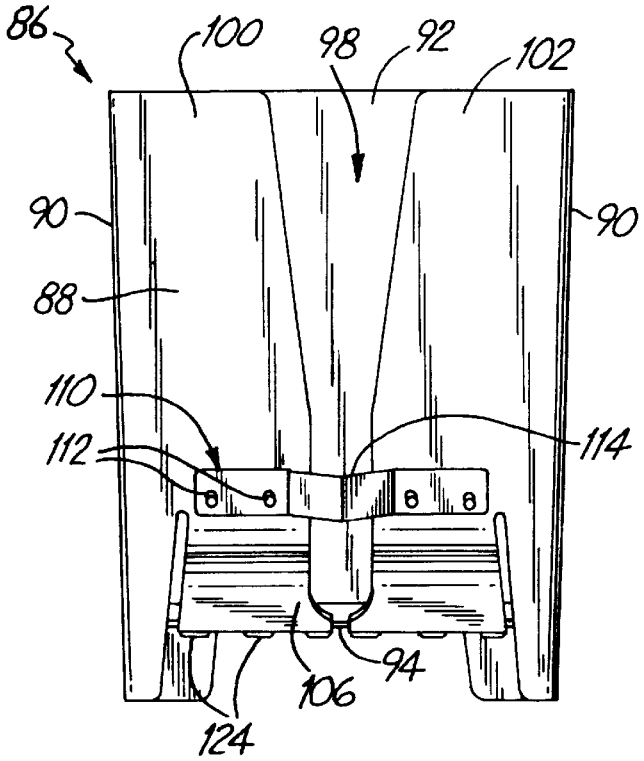
FIG. 7 is a front elevational view of the milk case of FIG. 6.

As best shown in FIGS. 6, 8 and 10, the side walls 90 include notches 120 at the bottom edge. The distance between the notches 120 on a side wall 90 is approximately the same as the width between the tops of the side walls 90. In the preferred embodiment, the distance between notches 120 on a side wall 90 is about 10½ inches, as is the top width of the milk case 86. The top edge of the side walls 90 include corresponding indents 122. The distance between the top indents 122 on a side wall 90 is approximately the same as the width between the bottom of the side walls 90. In the preferred embodiment, the distance between indents 122 on a side wall 90 is about 10 inches, as is the bottom width of the milk case 86. The notches 120 at the bottom edge mate with the corresponding indents 122 at the top edge to allow for crisscross stacking of a plurality of milk cases 86.

Any of the side walls 90 and the back wall 92 may slant slightly from the vertical, and the orientation of the side walls 90 and the back wall 92 is not overly critical. With the slight slant of the side walls 90 and the slant of the front wall 88 shown and described, the milk cases 86 are nestable within each other.

For ease of construction, the case 86 is preferably formed of rigid plastic sheet material. The front wall 88, the side walls 90 and the back wall 92 are formed of a single blank sheet of material, which is then bent into the configuration shown. The bottom wall 94 is formed of a second piece of material, and is thermally welded along seams to the side walls 90 and the back wall 92. The front wall 88 is curved and held to the bottom wall 94 by rivets 124. If desired, the bottom wall may alternatively be provided as a portion of a single blank attached to the back wall portion.

FIG. 11 shows loading of the milk dispenser 10 of the present invention. To load the device, the milk bag 40 is placed into the milk case 86 With the connector 104 received in the tapered upper portion of the opening 98. The connector 104 is then pushed downward and the milk baa 40 moved or turned until the connector 104 is all the way at the bottom of the opening 98. Turning of the bag 40 in this fashion causes the flexible tube 38 to bend upward in the V-portion 114 of the tie 110. The door 50 to the cabinet 12 is opened. The shelf 68 is moved to a position where it extends horizontally outward from the cabinet 12. The case/milk bag combination is raised onto the shelf 68 and slid backward into the cabinet 12. Once the case/milk bag combination is against the back wall 20 of the cabinet 12, the shelf 68 is raised and secured on the knobs 80. The shelf 68 includes cut-outs for unobstructed access to the flexible tube 38. The flexible tube 38 is pulled downward out of the V-portion 114 of the tie 110. The handle 34 is pulled fully upward, and the flexible tube 38 is 5 inserted and pulled through the valve opening 36. The handle 34 is released, and the flexible tube 38 is cut, such as with a scissors, as close to the end of the valve opening 36 as possible.

The loading procedure for the present invention is, in concept, very similar to the well-known loading procedure of the prior art beverage dispenser. The general steps include positioning the container in the case, positioning the case in the cabinet, inserting the flexible tube through the valve opening, and cutting the flexible tube. Because of the similarity of the general loading steps between the present invention and the prior art, employees readily understand the loading procedure. However, the specific steps followed to load the present invention are made much easier due to the preferred structure of the present invention.

Figure 12:
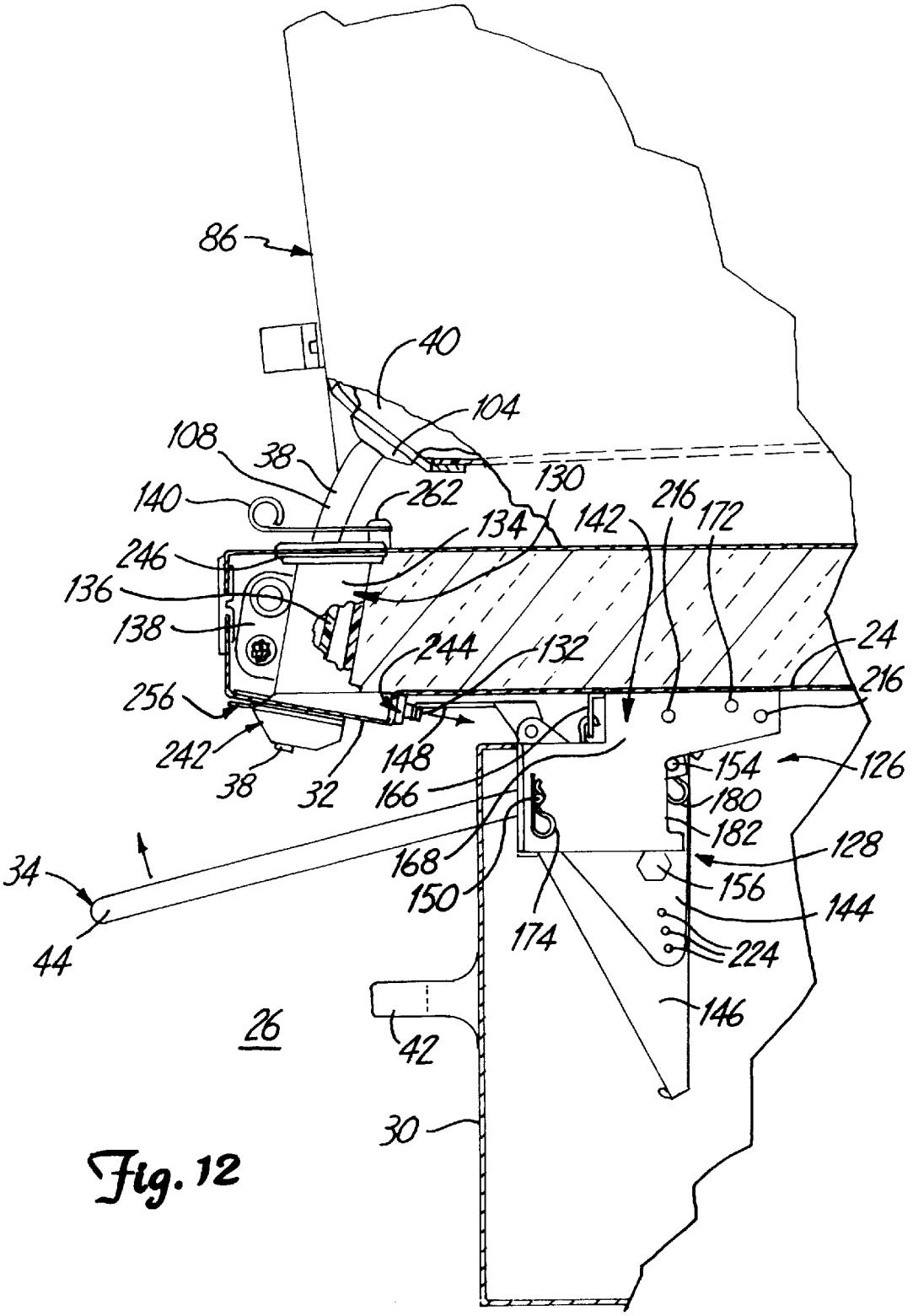
FIG. 12 is a side elevational view of the valve assembly in the milk dispenser taken along line 12—12 of FIG. 5.

FIG. 12 shows a side view of the valve 126 for the present invention. The valve 126 is located in the bottom wall 94 of the cabinet 12 along the top of the dispenser section 26. The valve 126 includes the previously described handle 34, an actuator 128 and a pinch mechanism 130. The pinch mechanism 130 normally biases or pinches the flexible tube 38 in a closed position. When a user raises upward on the handle 34, the actuator 128 opens the pinch mechanism 130, allowing milk to flow through the flexible tube 38. The pinch mechanism 130 includes a push rod 132, a valve opening housing 134, a pinch plate 136, a cooling plate 138, and a supplemental shut-off 140, each of which will be further described below with reference to FIGS. 19–24.

The actuator 128 of the present invention is both easy to assemble and reliable in performance. The various parts are generally formed by low cost bending or cutting operations on inexpensive, readily available, steel sheet or rod material. As importantly, the actuator 128 provides the desired force profile for operation of the valve 126 by the handle 34.

The actuator 128 shown in FIGS. 12–15 includes a frame bracket 142, an adjustment arm 144, a pivot arm 146, and a push arm 148. These members 142, 144, 146, 148 are pivotally connected relative to each other by a main pivot rod 150 and a push arm pivot 152. The adjustment arm 144 is secured from pivoting relative to the handle 34 by a stop pin 154. The pivot arm 146 is secured from pivoting relative to the adjustment arm 144 by an adjustment bolt 156. The handle 34 is pivotally biased relative to the frame bracket 142 by a main spring 158 and, at times, by a second spring 160. Each of the handle 34, the frame bracket 142, the adjustment arm 144, the pivot arm 146, the push arm pivot 152, the stop pin 154, the main spring 158 and the second spring 160 may be symmetrical about a center vertical bisecting plane 162.

The frame bracket 142 is rigidly secured to the cabinet 12 and has a top surface 164, a downwardly extending spring connection portion 166, and two flanges 168. Each of the flanges 168 are preferably identically shaped, and extend downwardly parallel to the bisecting plane 162. The frame bracket 142 may be formed by cutting and bending steel sheet material into the configuration shown and described.

The handle 34 is pivotally connected to the flanges 168 of the frame bracket 142 by the main pivot rod 150. The main pivot rod 150 may be separate from the frame bracket 142 for ease of assembly, but preferably does not move relative to the frame bracket 142. The handle 34 is not rigidly secured to the main pivot rod 150, and thus can rotate about the main pivot rod 150. In the preferred structure, the distance from the cross bar 46 of the handle 34 to the main pivot rod 150 is about 6 inches.

Figure 14:
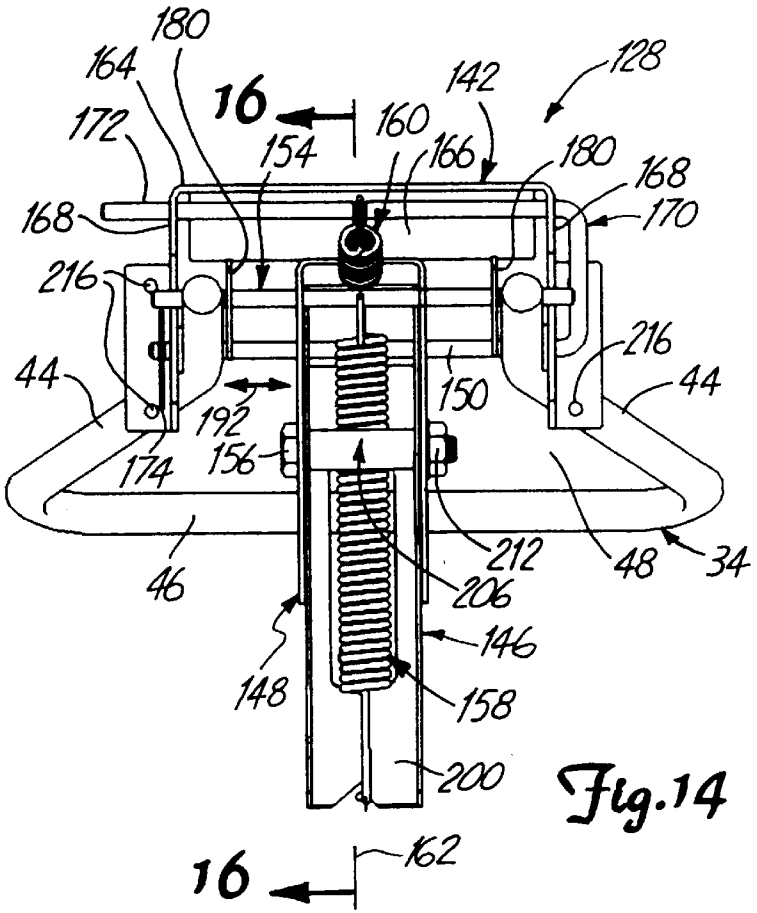
FIG. 14 is a rear elevational view of the actuator for the valve assembly of FIG. 12.
Figure 13:
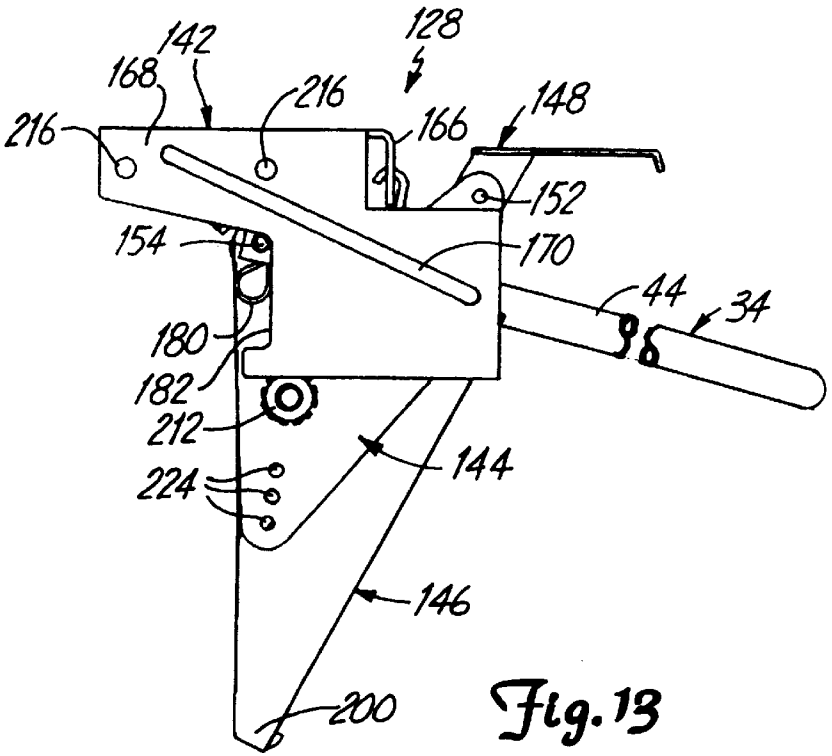
FIG. 13 is a left side elevational view of the actuator for the valve assembly shown in FIG. 12.
Figure 15:
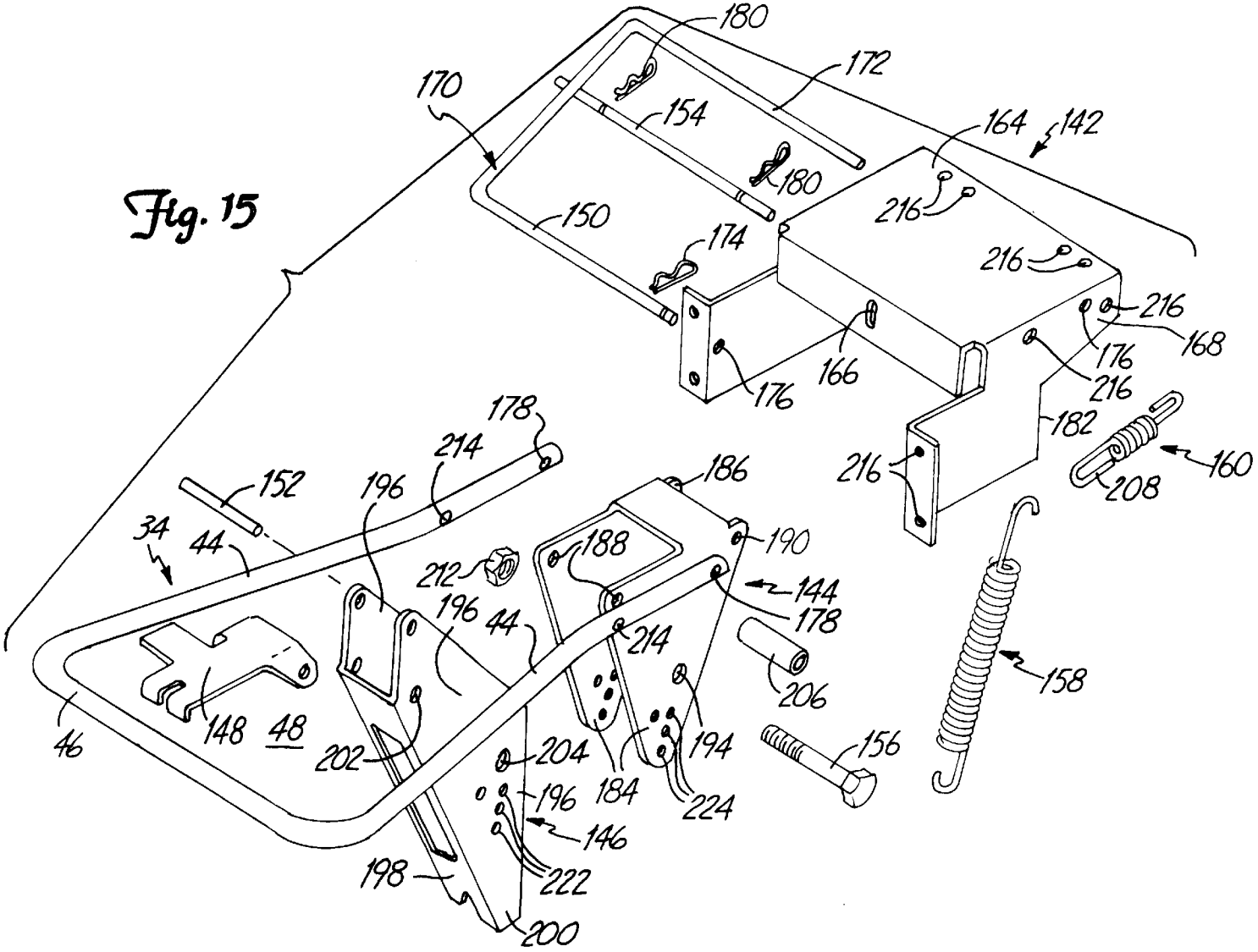
FIG. 15 is a perspective exploded view of the actuator for the valve assembly shown in FIG. 12.

As best shown in FIGS. 13, 14 and 15, the main pivot rod 150 may be provided by a steel rod bent into a U-bar 170, with the front leg of the U-bar 170 being the main pivot rod 150. Both the main pivot rod 150 and the rear leg 172 of the U-bar 170 are received in cooperatively sized holes 176 (shown in FIG. 15) in the flanges 168. Because of the U-bar 170, the main pivot rod 150 does not rotate with respect to the frame bracket 142. The main pivot rod 150 is axially secured to the frame bracket 142 by any convenient attachment structure such as by a cotter pin/groove connection 174 well known in the art. With the U-bar 170, a single cotter pin/groove connection 174 is all that is required to secure the main pivot rod 150 in place. Because the main pivot rod 150 does not rotate with respect to the frame bracket 142, there is no wear associated with the holes 176 in the flanges 168 or the cotter pin/groove connection 174. Alternatively, the main pivot rod 150 could be provided by a rod symmetrical about the bisecting plane 162 and/or secured to the frame bracket 142 in other ways.

As best shown in FIG. 14, the width between the two handle arms 44 is slightly less than the width between the two flanges 168 of the frame bracket 142. The width between the two arms 44 of the handle 34 allows the handle 34 to absorb a considerable moment about a longitudinal axis. With a wide separation between the two handle arms 44, the handle 34 provides a smooth pivoting motion without rocking even if the handle 34 is subjected to a twisting force or the force placed on the cross bar 46 of the handle 34 is not well centered (i.e., not in the bisecting plane 162).

The stop pin 154 is secured to the handle 34 adjacent the ends of the handle arms 44. As best shown in FIG. 14, the stop pin 154 has a length which is longer than the width between the flanges 168 of the frame bracket 142, and the ends of the stop pin 154 extend outward from the handle arms 44 past the flanges 168 of the frame bracket 142. The stop pin 154 may be separate from the handle 34 for ease of assembly, but does not move relative to the handle 34. The stop pin 154 may extend through holes 178 in each of the handle arms 44. In the preferred structure, the stop pin 154 is parallel to and about 2 inches from the main pivot rod 150. The stop pin 154 may be secured to the handle arms 44 by any convenient attachment structure such as by cotter pin/groove connections 180 well known in the art.

Each flange 168 on the frame bracket 142 has a range of travel slot 182 which cooperates with the stop pin 154. The range of travel slots 182 prevent the handle 34 from rotating more than a specified range relative to the frame bracket 142. For instance, in the preferred embodiment, the handle 34 can only be pivoted about 30° relative to the frame bracket 142. The range of travel slots 182 prevent the possibility of breakage of the components of the pinch mechanism 130 which might otherwise be caused due to overly rough handling of the handle 34. The range of travel slots 182 also assist in assembly of the actuator 128, as described below.

The adjustment arm 144 is secured to the handle 34 such as with the main pivot rod 150 and the stop pin 154. In the preferred embodiment and as best shown in FIGS. 14 and 15, the adjustment arm 144 preferably includes two plate portions 184 connected together by a horizontal link portion 186. The plate portions 184 extend downwardly parallel to the bisecting plane 162. The adjustment arm 144 may be formed by cutting and bending steel sheet material into the configuration shown and described.

The plate portions 184 of the adjustment arm 144 each have a hole 188 therein for the main pivot rod 150 and a hole 190 therein for the stop pin 154. The holes 188 allow the adjustment arm 144 to rotate with respect to the main pivot rod 150. The holes 188, 190 also allow the adjustment arm 144 to slide axially (perpendicular to the bisecting plane 162) on the main pivot rod 150 and the stop pin 154, as shown by arrows 192 in FIG. 14. Because the adjustment arm 144 is attached to the handle 34 through both the main pivot rod 150 and the stop pin 154, the adjustment arm 144 pivots with pivoting of the handle 34 about the main pivot rod 150. The width between the two plate portions 184 maintains the plate portions 184 of the adjustment arm 144 parallel to the bisecting plane 162 for smooth and stable pivoting about the main pivot rod 150. The plate portions 184 of the adjustment arm 144 each also have a hole 194 therein for the adjustment bolt 156.

The pivot arm 146 is secured to the adjustment arm 144 such as with the main pivot rod 150 and a tightened adjustment bolt 156. In the preferred embodiment and as best shown in FIGS. 14 and 15, the pivot arm 146 preferably includes two plate portions 196 connected together by a front link portion 198. The plate portions 196 extend rearwardly parallel to the bisecting plane 162. The plate portions 196 extend generally upward from the main pivot rod 150 to the push arm pivot 152. The plate portions 196 also extend generally downwardly and slightly rearwardly from the main pivot rod 150 to a lowermost end 200 for connection to the main spring 158. The pivot arm 146 may be formed by cutting and bending steel sheet material into the configuration shown and described.

The plate portions 196 of the pivot arm 146 each have a set of holes 202 therein for the main pivot rod 150, and the main pivot rod 150 extends through these holes 202. The holes 202 allow the pivot arm 146 to rotate with respect to the main pivot rod 150. The holes 202 also allow the pivot arm 146 to slide axially (perpendicular to the bisecting plane 162) on the main pivot rod 150, as shown by arrows 192 in FIG. 14. The width between the two plate portions 196 maintains the plate portions 196 of the pivot arm 146 parallel to the bisecting plane 162 for smooth and stable pivoting about the main pivot rod 150.

The width between the plate portions 196 of the pivot arm 146 is slightly less than the width between the plate portions 184 of the adjustment arm 144. Each plate portion 196 of the pivot arm 146 has an elongated hole 204 for receiving the adjustment bolt 156. A hollow tubular spacer 206 is positioned between the plate portions 196 of the pivot arm 146 and in alignment with the elongated hole 204. The spacer 206 prevents the plate portions 196 of the pivot arm 146 from bending together under the compressive load of the tightened adjustment bolt 156. When the adjustment bolt 156 is tightened, the pivot arm 146 is secured to the adjustment arm 144 and pivots with the adjustment arm 144 and the handle 34 about the main pivot rod 150. When the adjustment bolt 156 is loosened, the pivot arm 146 can rotate slightly relative to the adjustment arm 144, as will be described with reference to FIG. 17.

Figure 16:
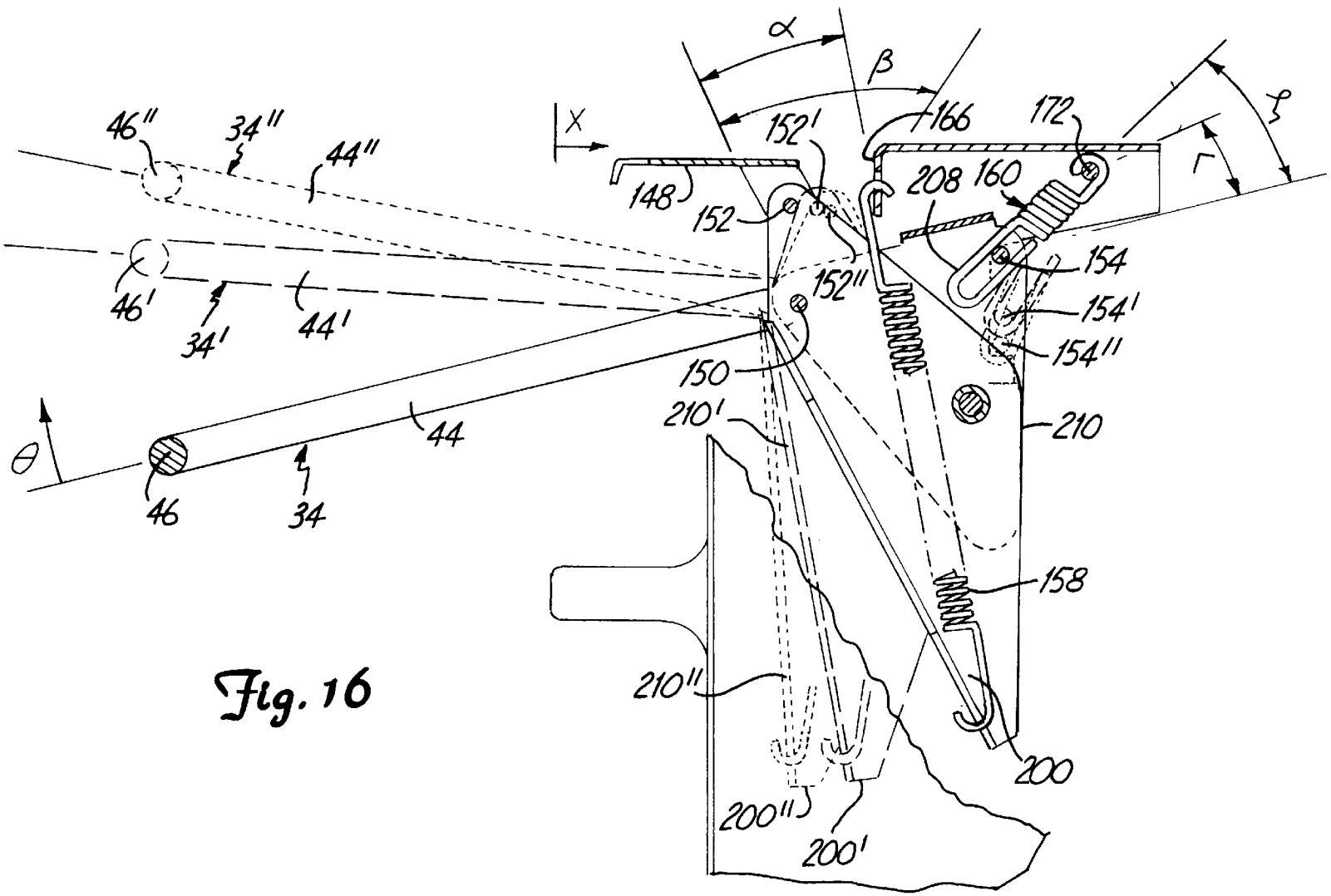
FIG. 16 is a cross-sectional view taken alone lines 16—16 in FIG. 14 showing the three stop position operation of the actuator for the valve assembly of FIG. 12.

The push arm 148 connects to the plate portions 196 of the pivot arm 146 at the push arm pivot 152. The push arm 148 pivots freely on the push arm pivot 152, and is only held in the horizontal position shown in FIGS. 12, 13, 15 and 16 by the push rod 132. As shown in FIGS. 12, 13 and 16, the push arm pivot 152 is generally vertically aligned with the main pivot rod 150. Upon raising of the handle 34, the push arm pivot 152 is pulled generally horizontally rearward by the pivot arm 146, and the push arm 148 travels nearly linearly rearward (i.e., in the positive x direction shown in FIG. 16).

The handle 34 is biased (counterclockwise in FIGS. 12 and 16 clockwise in FIG. 13) about the main pivot rod 150 by the main spring 158. The main spring 158 connects at one end to the downwardly extending spring connection portion 166 of the frame bracket 142, and at the other end to the lowermost end 200 of the pivot arm 146.

The main spring 158 is preferably a tension spring with a large number of coil turns such as thirty-five. The free length of the main spring 158 may be ½ to 1 inch less than the distance between connection points 166, 200. When stretched for initial assembly, the preferred main spring 158 has a tension at about 15 pounds, with the minimum practical spring rate.

The second spring 160 is attached at one end to the rear leg 172 of the U-bar 170. The other end of the second spring 160 includes an elongated hook 208 around the stop pin 154. The free length of the second spring 160 may be about ½ of an inch longer that the distance between these connection points 172, 154 when the valve 126 is in the normal closed position. The preferred second spring 160 when stretched has an initial tension of 6 to 9 pounds.

Use of the stop pin 154 and the main pivot rod 150 allows for ease of assembly of the actuator 128, which will be described with particular reference to FIG. 15. Workers skilled in the art will appreciate that the assembly process described is merely a preferred assembly, and that the assembly process may be widely varied to produce equivalent results.

In assembling the actuator 128, first the adjustment arm/pivot arm combination 210 is assembled. The push arm 148 is attached for pivoting relative to the pivot arm 146 by the push arm pivot 152. The push arm pivot 152 can be any structure known in the art for providing a pivotable connection. The spacer 206 is aligned with the elongated holes 204 in the plate portions 196 of the pivot arm 146. The adjustment arm 144 is fitted over the pivot arm 146 so that the adjustment bolt holes 194 also line up with the elongated holes 204. The adjustment bolt 156 is inserted through the aligned adjustment arm 144, pivot arm 146 and spacer 206. A nut 212 is threaded onto the adjustment bolt 156 and finger tightened.

Next the handle 34 is attached to the adjustment arm/pivot arm combination 210. The stop pin holes 178 in the end of the handle arms 44 are aligned with the stop pin holes 190 in the adjustment plate, and the stop pin 154 is inserted through these aligned holes 178. 190. If desired, the elongated hook 208 of the second spring 160 may be placed onto the stop pin 154 halfway through insertion of the stop pin 154 through the aligned holes 178, 190, while the stop pin 154 is through only one of the stop pin holes 190 in the adjustment arm 144. Once the stop pin 154 is fully inserted, it is secured relative to the handle 34 such as by cotter pins 180.

The U-bar 170 is then used to attach the handle/adjustment arm/pivot arm combination to the frame bracket 142. The main pivot rod 150 and the rear leg 172 are inserted through one flange 168 of the frame bracket 142. The pivot hole 214 in one arm 44 of the handle 34 is aligned and the main pivot rod 150 is inserted through this pivot hole 214. The pivot holes 188, 202 of the adjustment arm 144 and the pivot arm 146 are aligned, and the main pivot rod 150 is inserted through these holes 188, 202. The second spring 160 is hooked over the rear leg 172 of the U-bar 170. The main pivot rod 150 is inserted through the pivot hole 214 of the opposite arm 44 of the handle 34, and both the main pivot rod 150 and the rear leg 172 are inserted through the second flange 168 of the frame bracket 142. The main pivot rod 150 is secured in this fully inserted position such as by the cotter pin 174.

Finally, the main spring 158 is hooked to the spring connection portion 166 of the frame bracket 142 and extended and hooked to the lowermost end 200 of the pivot arm 146. Remaining holes 216 in the frame bracket 142 may be used to attach the actuator 128 to the cabinet 12.

Operation of the valve actuator 128 will now be described with reference to FIGS. 16 and 17. During operation, the pivot arm 146 is rigidly attached to the adjustment arm 144 through the tightened adjustment bolt 156, and thus the pivot arm 146 and the adjustment arm 144 drawn in FIG. 16 for simplicity as a single combination arm 210. Also for simplicity, the coils of the main spring 158 and the second spring 160 are shown in partial detail in FIG. 16.

The actuator 128 of the present invention has three defined stop positions. In a first or fully closed position, the flexible tube 38 is pinched shut and there is no beverage flow. In a second or full flow position, the valve 126 places limited pressure on the flexible tube 38, but not so much pressure as to cause the flexible tube 38 to fully pinch or close. The limited pressure creates a friction force between the valve 126 and the flexible tube 38 to prevent the flexible tube 38 from being inadvertently removed from the valve opening 36. If desired, the limited pressure may also slightly compress the opening of the flexible tube 38 to reduce the flow rate at the full flow position. In a third or fully open position, the valve 126 places no pressure on the flexible tube 38, and the flexible tube 38 can be readily inserted or removed from the valve opening 36.

The pivot arm 146 is held in the normally closed position by the main spring 158. In the normal, valve fully closed position shown in FIGS. 12–14, the stop pin 154 contacts the upper end of the range of travel slot 182 to prevent the handle 34 from moving. The upper end of the range of travel slot 182 thus provides the first, valve fully closed, stop position for the actuator 128.

When the user pulls or pushes upward on the cross bar 46 of the handle 34 sufficient to overcome the biasing force of the main spring 158, the handle 34 pivots about the main pivot rod 150, increasing the angle Θ. As the cross bar 46 of the handle 34 pivots up, the stop pin 154 travels downward in the range of travel slot 182. If the cross bar 46 of the handle 34 is pivoted sufficiently far, the stop pin 154 will contact and engage the elongated hook 208 of the second spring 160. The engagement point of the second spring 160 thus provides the second, full flow, stop position for the actuator 128. This full flow stop position is shown in FIG. 16 in dashed lines, and reference numerals in this position are marked with a prime (′). In the preferred embodiment, the handle 34 pivots through about a 20° angle Θ from the normal closed position to the frill flow position.

When an employee pulls or pushes upward on the cross bar 46 of the handle 34 sufficient to overcome the biasing force of the second spring 160, the handle 34 pivots further about the main pivot rod 150. As the cross bar 46 of the handle 34 pivots further upward, the stop pin 154 travels further downward in the range of travel slot 182. If the cross bar 46 of the handle 34 is pivoted sufficiently far, the main pivot rod 150 will contact the lower end of the range of travel slot 182 to prevent further pivoting of the handle 34. The lower end of the range of travel slot 182 thus provides the third, valve fully open, stop position for the actuator 128. This fully open stop position is shown in FIG. 16 in dashed lines, and reference numerals in this position are marked 5 with a double prime (″). In the preferred embodiment, the handle 34 pivots through about a 30° angle Θ from the normal closed position to the fully open position.

Figure 17:
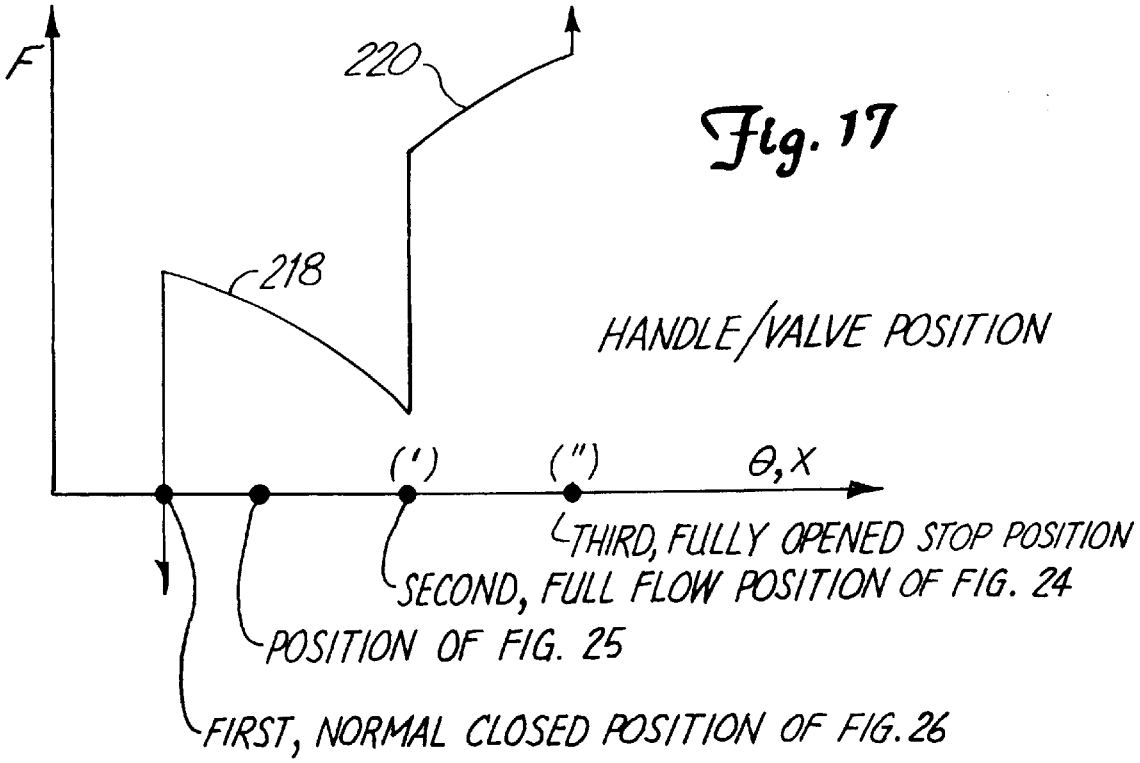
FIG. 17 is a graph of force versus handle and pinch plate position for the valve assembly of FIG. 12.

The preferred force profile to lift the handle 34 and open the valve opening 36 is shown in FIG. 17. The force required to initially lift the handle 34 from the closed position is preferably 2 to 5 pounds. This initial lifting force is preferably greater than the force to hold the handle 34 up during a full flow from the beverage dispenser 10. The decreasing force that the actuator 128 places on the handle 34 during opening of the valve 126 is shown by the downwardly slanting line 218. This allows the user, once overcoming the initial force of the main spring 158, to easily move the valve 126 to a full flow position and to hold the valve 126 at a full flow position without tiring. Some force, preferably about 1 to 3 pounds, needs to be retained on the handle 34 to maintain the valve 126 in a full flow position, but not as treat of a force as was initially required to open the valve 126.

After the full flow position is obtained, a user has no reason to further open the valve 126. The user feels an increase in resistance associated with the second stop position, and does not further attempt to open the valve 126. Inadvertent movement of the flexible tube 38 in the valve opening 36 is avoided.

An employee will want to open the valve 126 to the fully open position to remove or insert a flexible tube 38 into the valve opening 36. The employee lifts firmly on the handle 34 to move the valve 126 to the fully open position. Preferably the resistance that the actuator 128 places on the handle 34 to move from the full flow position to the fully open position is 5 to 10 pounds. This force is small enough that virtually all employees will be able to provide it with a single hand, but large enough that users will ordinarily stop at the second, full flow position.

The operation of the actuator 128 to achieve this desired force profile will now be described. When the cross bar 46 is pulled upward, rotation of the pivot arm 146 causes a slight expansion of the main spring 158. When the lowermost end 200 of the pivot arm 146 rotates forward, the distance between the lowermost end 200 of the pivot arm 146 and the main spring connection point of the frame bracket 142 increases slightly, lengthening the main spring 158. In the preferred configuration shown, the main spring 158 is stretched only about ¼ of an inch when the handle 34 moves through a full 30° range of travel. During this same range of travel, the cross bar 46 of the handle 34 moves about 3 and ¾ inches.

The tension in the main spring 158 tends to resist the movement of the cross bar 46 of handle 34 upward. The length of the preferred handle 34 gives an initial mechanical advantage of six to ten times relative to the spring force of the main spring 158, and the initial lifting force required to lift the handle 34 is between 2 and 5 pounds. A linear forte on the push arm 148 in the x direction of 10 to 30 pounds would similarly overcome the tension in the main spring 158 and open the valve opening 36.

As stated earlier, after the initial resistance is overcome, the actuator 128 provides a downwardly sloping force profile 218 and the valve 126 actually gets easier to open. This downwardly sloping force profile 218 is accomplished in the actuator 128 of the present invention through two different but interrelated force mechanisms. First, the moment force placed on the pivot arm 146 by the main spring 158 is a function of the sine of the angle α between the main spring axis and the lowermost end 200 of the pivot arm 146 relative to the main pivot rod 150. The angle cα between the main spring 158 and the pivot arm 146 is initially quite acute, such as about 15°. As this angle α becomes even smaller due to rotation of the handle 34, the moment of the spring force placed on the pivot arm 146 becomes less. The mechanical advantage associated with the handle 34 thus becomes greater as the valve 126 is opened.

Second, the amount of expansion which the main spring 158 undergoes (i.e., the length of the main spring 158) is a function of the locus of the lowermost end 200 of the pivot arm 146 relative to spring connection portion 166 of the frame bracket 142. Because the lowermost end 200 of the pivot arm 146 moves in a circle about the main pivot rod 150, the amount of extension of the main spring 158 varies as a function of the sine of the angle β between the spring connection points 200, 166 relative to the main pivot rod 150. During pivoting of the handle 34, the angle β becomes less, and less additional spring tension is produced per amount of handle pivoting. Through these two complimentary mechanisms, even though the tension force exerted by the main spring 158 becomes greater as the valve 126 is opened, the force required to open the valve 126 for full flow is less than the force required to initially open the valve 126.

The stop pin 154 can move from the first position to the second position before any engagement or lengthening of the second spring 160 occurs. The second spring 160 does not provide any force to the handle 34 between the first, normal closed position and the second full flow position. After engagement, the same two force mechanisms discussed above are used oppositely for the second spring 160. The angle Γ between the rear leg 172 of the U-bar 170 and the stop pin 154 relative to the main pivot rod 150 increases and approaches 90° as the handle 34 is further pivoted. The angle ζ between the second spring axis and the handle 34 also increases and approaches 90° as the handle 34 is further pivoted. Additionally, the tension force provided by the second spring 160 increases as the second spring 160 is stretched. Accordingly, the force profile of the handle 34 shows an increasing slope 220 from the second full flow position to the third fully open position.

Adjustment of the valve actuator 128 will now be described with reference to FIG. 18. The primary reason for adjustment is to allow higher acceptable tolerances in construction of the actuator 128 and the pinch mechanism 130 and in mounting of the frame bracket 142 of the actuator 128 relative to the pinch mechanism 130. The higher acceptable tolerances are particularly beneficial due to the number of connecting parts between the handle 34 and the pinch plate 136. Without any adjustment features, the lengths of each of these interacting parts would need to be tightly toleranced, such that the valve 126 would work in the worst case scenario when the part lengths and the mounting of the actuator 128 were all off in The same direction. A large number of highly toleranced parts leads to a higher cost of manufacture or a higher reject rate. With the adjustment features of the present invention, the length and connection between each of the parts does not have to be tightly toleranced, and the actuator 128 does not have to be precisely located relative to the pinch mechanism 130.

Figure 18:
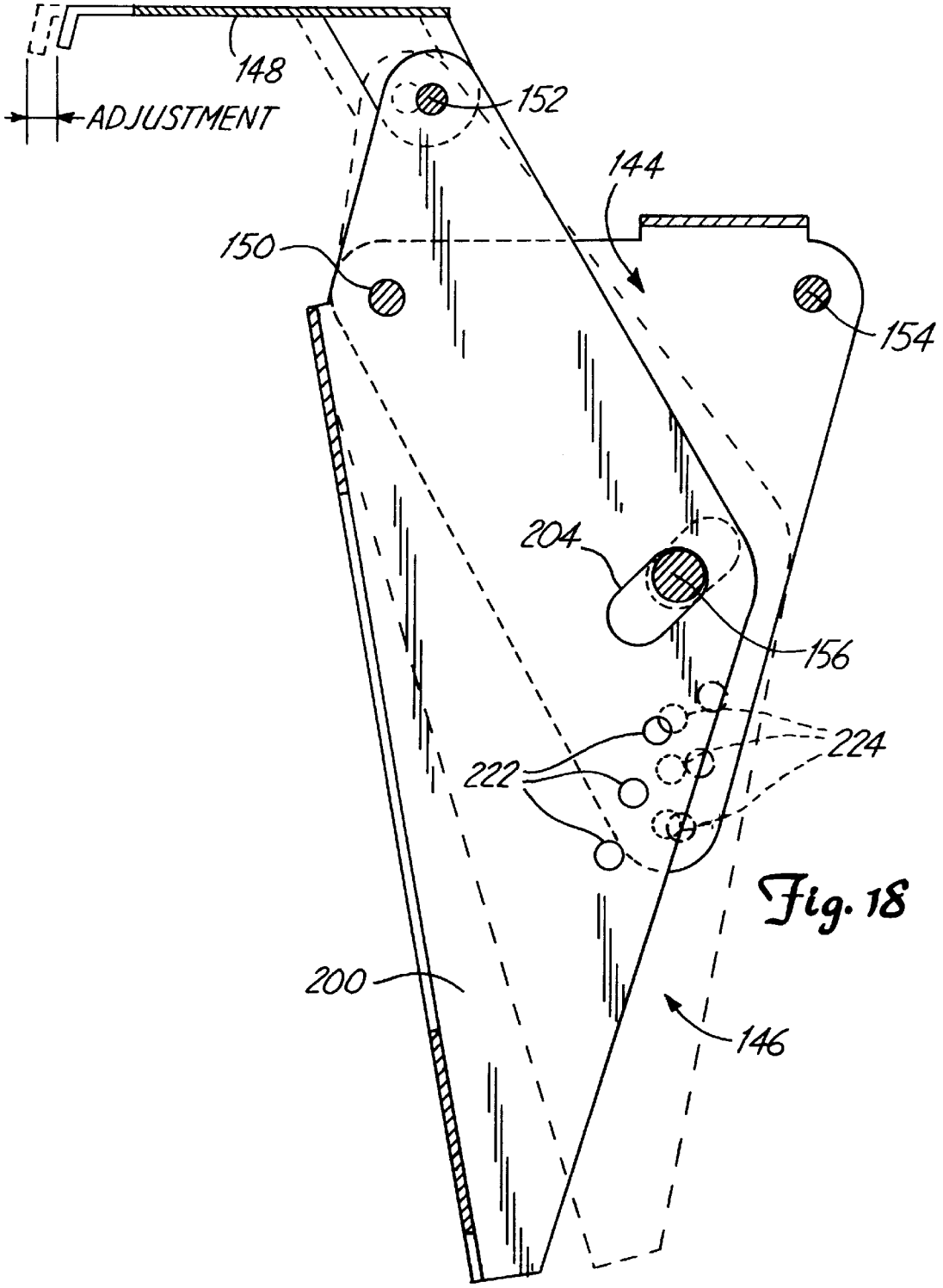
FIG. 18 is a side cross-sectional view showing positional adjustment provided by the adjustment plate of FIG. 12.

FIG. 18 shows the range of Movement of the pivot arm 146 relative to the adjustment arm 144 when the adjustment bolt 156 is loose. Both the pivot arm 146 and the adjustment arm 144 pivot about the main pivot rod 150. The elongated hole 204 for the adjustment bolt 156 in the pivot arm 146 allows the pivot arm 146 to have some degree of rotational freedom with respect to the adjustment arm 144. When the pivot arm 146 is positioned with the adjustment bolt 156 in the front of the elongated hole 204 as shown in solid lines on FIG. 18, the push arm 148 is in a far extended position. When the pivot arm 146 is positioned with the adjustment bolt 156 in the back of the elongated hole 204 as shown in dashed lines on FIG. 18, the push arm 148 is in a far retracted position. The pivot arm 146 can also be secured to the adjustment arm 144 at any intermediate position between the far extended position and the far retracted position, simply by tightening the adjustment bolt 156.

Three alignment holes 222 are disposed in a line on the pivot arm 146. A corresponding three alignment holes 224 are provided in a line on the adjustment arm 144, but the line of alignment holes 224 on the adjustment arm 144 is slightly offset with respect to the line of alignment holes 222 on the pivot arm 146. For instance, the three holes 222 on the pivot arm 146 can define a line which intersects the adjustment bolt 156, but the three holes 224 on the pivot arm 146 can define a line which does not intersect the elongated hole 204 for the adjustment bolt 156. Because of this offset between lines of alignment holes 229, 224, only two holes can align between the pivot arm 146 and the adjustment arm 144 at any given time. Which two holes are aligned will define the angular location of the pivot arm 146 with respect to the adjustment arm 144. Once the proper adjustment is made, a pin (not shown) may be placed in the aligned holes to secure this adjustment location, in addition to the tightening of the adjustment bolt 156.

The adjustment between the pivot arm 146 and the adjustment arm 144 can be manually performed before or after the beverage dispenser 10 is fully assembled. The adjustment should be made such that the pinch plate 136 fully closes a flexible tube 38 When the handle 34 and the actuator 128 are in the fully closed position, but such that the pinch plate 136 does not fully pinch the flexible tube 38 when the handle 34 and the actuator 128 are in the full flow position.

Additionally, the actuator 128 of the present invention is self adjusting. To perform the self adjustment, the beverage machine 10 is fully assembled without tightening of the adjustment bolt 156. The handle 34 is fully raised, a flexible tube 3S is placed in the valve opening 36, and the handle 34 is lowered to the normal, closed stop position. The resistance of the flexible tube 38 to pinching by the pinch plate 136 will provide a proper adjustment between the pivot arm 146 and the adjustment arm 144. The adjustment bolt 156 is then tightened in place. The adjustment bolt 156 is located substantially underneath the frame bracket 142 and with no interfering structures around it, and accordingly can be easily accessed from the front of the beverage dispenser 10 without any disassembly.

The self adjustment of the adjustment arm 144 relative to the pivot arm 146 is further explained as follows. When the actuator 128 is fully assembled but the adjustment bolt 156 is loose, the pivot arm 146 is automatically biased by the main spring 158 toward the fully extended position. During the self adjustment procedure described above, a compression force provided by the flexible tube 38 acts on the push arm 148 to counterbalance the biasing force of the main spring 158. In the preferred embodiment, a force of about 12 pounds on the push arm 148 will provide a moment about the main pivot rod 150 which equally counterbalances the moment provided by the about 15 pound force of the main spring 158. The flexible tube 38 will provide a 12 pound compression force on the pinch plate 136 only when the flexible tube 38 is pinched fully closed but not overly crushed. Tightening of the adjustment bolt 156 at this orientation will accordingly assure proper force is placed on the flexible tube 38 by the pinch plate 136 for leak free closing of the valve 126. The self-adjustment feature of the present invention thus allows the milk dispenser manufacturer to select the "proper" compression force on the flexible tube 38 through selection of the main spring force and orientation. Alternatively, the self adjustment procedure may be performed by following the same procedure detailed above except inserting an incompressible adjustment shim (not shown) in the valve opening 36 rather than the flexible tube 38. The adjustment shim should be thinner than the closed thickness of all types of flexible tubes 38 which may be used. A 0.030 inch thick adjustment shim has been found to work suitably. Self adjustment with a thin adjustment shim assures that the entire closing force of the actuator 128 is transmitted to any types of flexible tube 38 before contact between the stop pin 154 and the upper end of the range of travel slot 182. Self adjustment with an adjustment shim is particularly useful in situations where flexible tube construction may vary from container to container, but will always have a closed thickness greater than the thickness of the adjustment shim.

The actuator 128 assembly of the present invention is also adjustable in the width direction (i.e., for longitudinal positioning on the main pivot rod 150, or, if a set of polar coordinates are taken about the main pivot rod 150 in the z-direction) as shown by the arrows 192 in FIG. 14. The width of the two plates 184 of the adjustment arm 144 is substantially less than the distance separating the two arms 44 of the handle 34. This allows for a substantial amount of axial adjustment of the adjustment arm/pivot arm combination 210 relative to the handle 34. The preferred adjustment arm/pivot arm combination 210 slides axially or longitudinally for a distance of about 1½ inches on the main pivot rod 150 and the stop pin 154 and between the arms 44 of the handle 34. So long as the frame bracket 142 is mounted in line with the valve opening 36 within a tolerance of ¾ of an inch, the adjustment arm/pivot arm combination 210 can be slid to have the push arm 148 line up for attachment with the push rod 132. The widthwise adjustment accordingly ensures that the push arm 148 can be easily aligned with the push rod 132 for the valve 126, even if the valve location in the cabinet 12 and the location for attachment of the frame bracket 142 are not well aligned with respect to each other.

While the adjustment arm/pivot arm 210 has this freedom of motion, the main spring 158 is attached in the widthwise center of the frame bracket 142. The main spring connection point 166 of the frame bracket 142 does not move longitudinally with respect to the handle 34. Any widthwise adjustment of the adjustment arm/pivot arm pulls the main spring 158 at an angle to the bisecting plane 162, and the main spring 158 tends to resist this lengthening and provides a widthwise or z-component force on the adjustment arm/pivot arm 210. The main spring 158 automatically biases the adjustment arm/pivot arm 210 toward a central position.

Workers skilled in the art will appreciate that the spring tensions, the lengths of the respective moment arms, and the angular relationships between the respective moment are can all be selected to provide the most beneficial force profile for the particular intended situation of the beverage dispenser. Workers skilled in the art will also appreciate that the actuator 128 of the present invention may be provided by a wide array of structural modification and still obtain the benefits of the present invention. As a simple example of this, the stop pin 154 described herein is not necessary at all. Instead, the ends of the handle 34 could be bent outward to provide the stopping function within the range of travel slots 182, and the second spring 160 could be otherwise attached to the frame bracket 142.

Similarly, while the range of travel slot 182 assists in assembly of the beverage dispenser, the three stop position described herein can be attained without any range of travel slot 182 at all. The first, valve fully closed position can be provided merely by resistance of the flexible tube 38, and the third, valve fully open position provided by resistance of the pinch plate 136 when it contacts the valve opening 36.

As other examples of simple but equivalent structural modifications, any of the pivot points could be provided by other types of connections other than the pivot rod connections described herein, and any of the pivot arm 146, adjustment arm 144, push arm 148 and frame bracket 142 could be alternatively made without a dual plate structure. Numerous more complex modifications could be similarly made while capturing the essence of the actuator 128 of the present invention.

Figure 19:
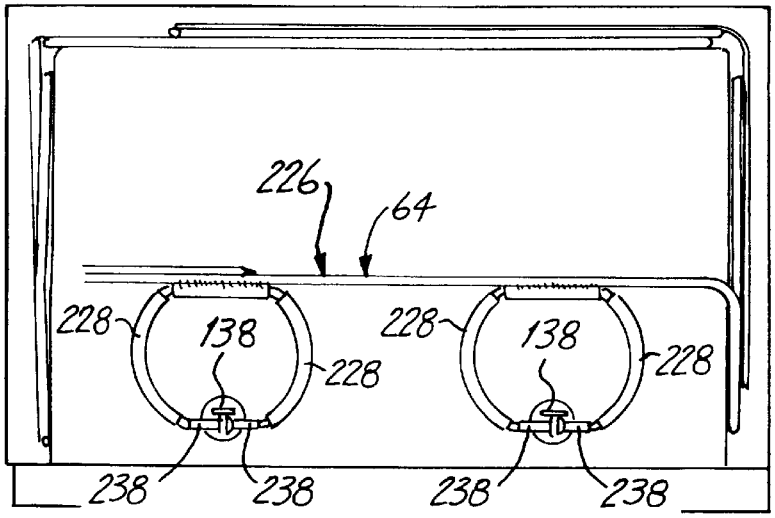
FIG. 19 is a sectional view showing the cooling apparatus for the pinch mechanism of the valve assembly taken along,line 19—19 of FIG. 2.

FIG. 19 is a view from the bottom of the cabinet 12 showing attachment of the cooling plate 138 to the refrigeration system. The evaporator coil 64 of the refrigeration system includes a bottom run 226 which extends between the side walls 16, 1S of the cabinet 12. The cooling plate 138 is included in each of the valve openings 36 toward the front of the cabinet 12. The cooling plate 138 is thermally connected to the refrigeration system, and the valve opening 36 is refrigerated by the refrigeration system of the cabinet 12. Preferably the cooling plate 226 extends longitudinally along about 2 to 3 inches of the valve opening 36.

Figure 20:
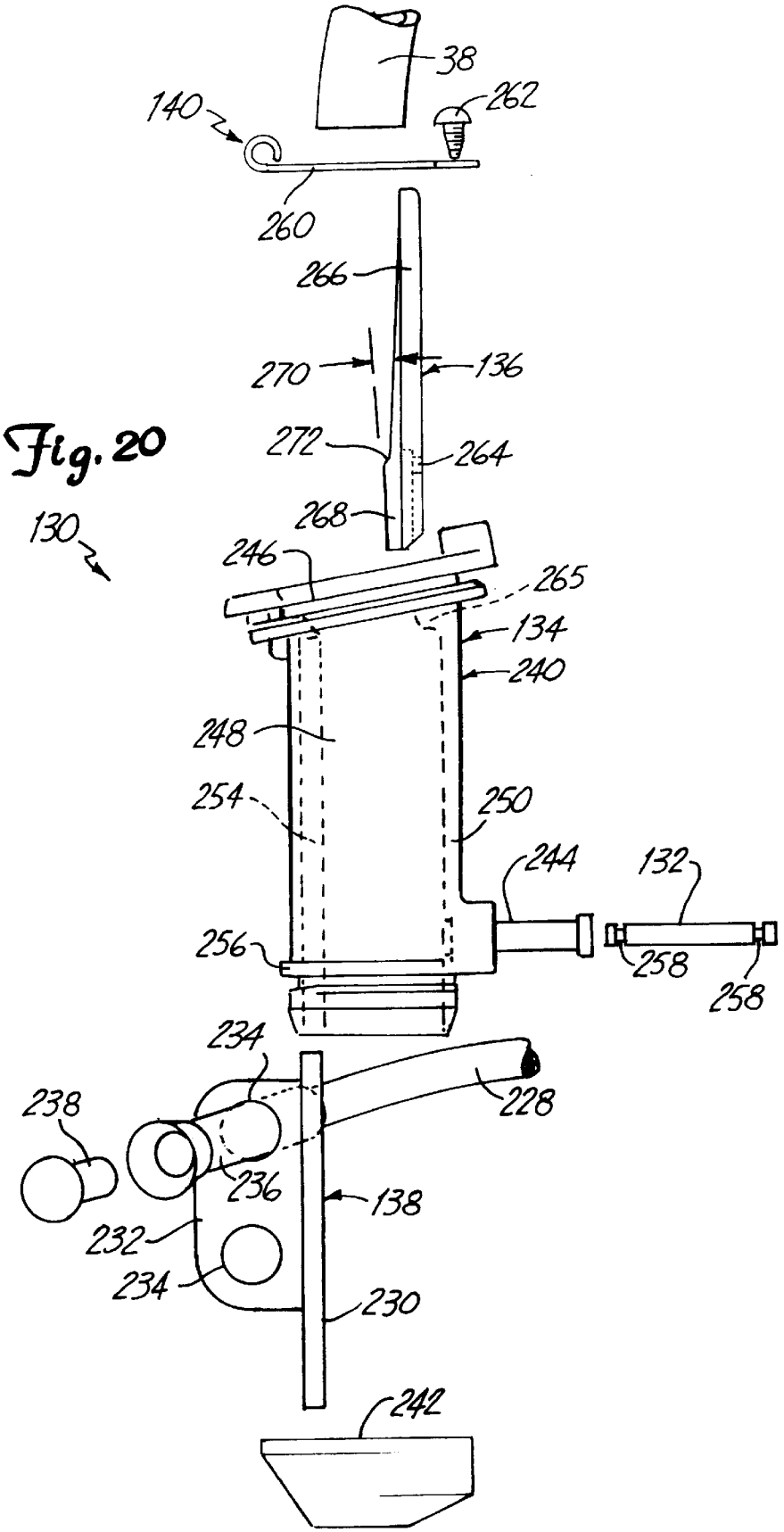
FIG. 20 is an exploded side view of the pinch mechanism of the valve of FIG. 12.

The preferred structure to thermally connect the cooling plate 138 includes two flexible metal cables 228, shoe n in full in FIG. 19 and in part in FIG. 20. The cooling plate 138 includes a cooling surface 230 and a connection flange 232. The connection flange 232 includes two openings 234, each for attachment to one flexible metal cable 228.

The preferred flexible metal cable 228 is a #4 copper battery cable. The cable 228 is welded, soldered or otherwise attached in intimate thermal contact with the bottom run 226 of the evaporator coil 64. The flexibility of the cable 228 allows the cable 228 to be attached at a wide variety of locations along the bottom run 226, and placement of the cable 228 relative to the bottom run 226 is not critical during assembly. The cable 228 is preferably thermally attached to the evaporator coil 64 and to the cooling plate 138 prior to insulating the cabinet 12 and around the cable 228.

As best shown in FIG. 20, the cable 228 preferably ends with a tube 236. Tube 236 is attached to cable 228 in intimate thermal contact such as through crimping or soldering. The outer diameter of the tube 236 is slightly smaller than the opening 234 of the connection flange 232. The tube 236 is inserted into the opening 234, and a rivet 238 is forced under high pressure into the tube 236 from the open side. The rivet 238 widens the tube 236 against the opening 234 in the connection flange 232, so that intimate thermal contact is established between the cable 228 and the cooling plate 138.

The cooling plate 138 is preferably formed out of extruded aluminum. The aluminum of the cooling plate 138 provides the desired thermal properties for the cooling plate 138, as does the copper of the cable 228. The most important thermal property for both the cooling plate 138 and the cable 228 is a high thermal conductivity, which is provided by both copper and aluminum. The aluminum is preferably finished by hard anodizing. The cooling plate 138 thus provides a readily cleaned, low corrosion cooling surface 230 for direct contact with the flexible tube 38. The extruded aluminum can be easily manufactured to a high tolerance part.

The flexible tube 38 is normally biased against the cooling plate 138 by the pinch plate 136. Workers skilled in the art will appreciate that the cooling plate does not have to be the backing plate opposite the pinch plate 136, and that the pinch plate need not extend along flexible tube 38 for any significant length. With the cooling plate 138 doubling as the backing plate for the pinch plate 136, and with the pinch plate 136 being a plate which extends longitudinally along a significant length of flexible tube 38, there is a significant length of the flexible tube 38 which is held in pressed contact with the cooling plate 138. This significant length of pressed contact with the cooling plate 138 provides better thermal conduction between the cooling plate 138 and the milk in the flexible tube 38.

Figure 22:
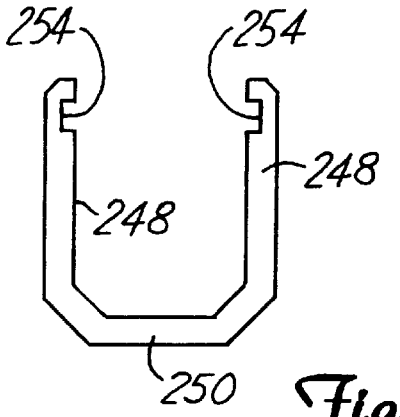
FIG. 22 is a cross-sectional view of the valve body taken along line 22—22 of FIG. 21.
Figure 21:
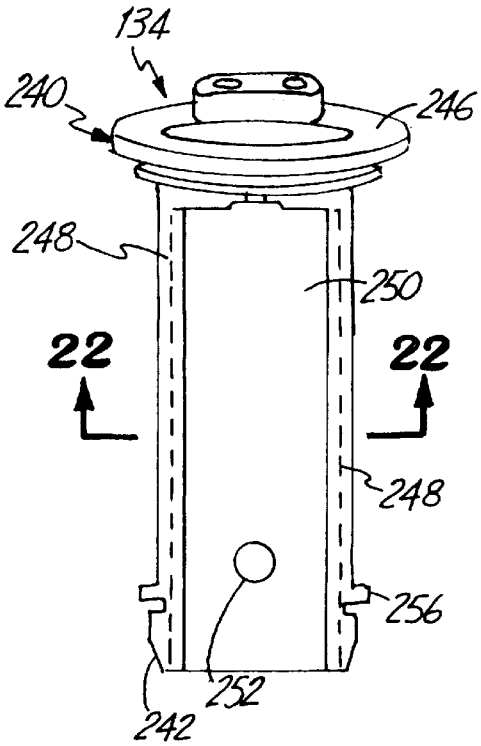
FIG. 21 is a front elevational view of the valve body of FIG. 20.

As best shown in FIGS. 20–22 the preferred valve opening housing 134 includes a body 240, an end cap 242, and a bushing 244. Each of the body 240, the end cap 242, the bushing 244 and the pinch plate 136 may be molded of plastic such as acetal copolymer, providing an easily cleaned, inert part for use in a food environment.

The body 240 includes a top flange 246 disposed at an angle to the longitudinal axis of the body 240. When assembled into the cabinet 12 as shown in FIG. 12, the top flange 246 sits square and flat relative to the horizontal surface of the bottom wall 24 of the cabinet 12. The angle of the too flange 246 accordingly places the valve opening housing 134 at an angle to vertical, such that the flexible tube 38 in the valve opening housing 134 extends forwardly and downwardly as it extends through the valve opening 36. The top flange 246 is preferably annular, providing strength to the body 240.

The body 240 has two side walls 248 and a rear wall 250 extending downward from the top flange 246. The side walls 248 and the rear wall 250 define a generally rectangular valve opening 36. The rear wall 250 includes a push rod opening 252 to receive the bushing 244 and the push rod 132 therethrough.

As best shown in FIG. 22, the side walls 248 each include a cooling plate slide groove 254. The cooling plate slide groove 254 is the width of the cooling plate 138, and the cooling plate 138 is slidable upward into the cooling plate slide grooves 254. While the side walls 248 hold the cooling plate 138 in place, they also allow the cooling plate 138 to be slid downward in the cooling plate slide grooves 254 for cleaning outside the valve body 240. Alternatively the cooling plate 138 may be secured in the cooling plate slide grooves 254 by the insulation around the flexible cables 228 and by the outside of the bottom wall 24.

The body 240 includes a bottom flange 256 which is smaller than the top flange 246. The small size of the bottom flange 256 allows the body 240 to be inserted downwardly from above into an opening defined in the bottom wall 24 of the cabinet 12, until the top flange 246 contacts the upper surface of the bottom wall 24.

The end cap 242 is secured on the body 240 from below, after the body 240 is positioned in the bottom wall 24. The end cap 242 is annular, and defines the valve opening 36 through which the flexible tube 38 extends. The end cap 242 preferably mates on the body 240 with an interference detent fit so the end cap 242 can be snapped on to the bode 240 with a tactile click, as is well known in the plastic part art. The central opening of the end cap 242 is too small to allow either the cooling plate 138 or the pinch plate 136 to be removed out of the bottom of the valve opening 36.

The bushing 244 is attached to the push rod opening 252 such as through a threaded connection. The bushing 244 is tubular and provides a bearing surface for the push rod 132, assuring that the push rod 132 slides linearly backwardly and forwardly relative to the valve body 240 with no angular or pivoting component.

The push rod 132 extends through the bushing 244 and the push rod opening 252 to couple the pinch plate 136 to the push arm 148 of the actuator 128. Each end of the push rod 132 includes a groove 258 for respective attachment to push arm 148 and the pinch plate 136. The push rod 132 may be formed of stainless steel. Both the bushing 244 and the push rod 132 are assembled to the housing 134 after the housing 134 is positioned in the bottom wall 24 of the cabinet 12.

A simple secondary shut-off 140 is provided on the inside of the cabinet 12. The preferred secondary shut-off 140 includes two bent wire pinchers 260, each of which is attached to the valve body 240 with a bolt 262. The pinchers 260 each pivot about the respective bolt 262 and generally normal to the longitudinal axis of flexible tube 38. The arms of the pinchers 260 interlock with each other in a closed position to pinch the flexible milk tube 38 shut. Workers skilled in the art will appreciate that a wide variety of alternative secondary cutoff structures could equivalently be used.

The secondary shut-off 140 is entirely inside of the cabinet 12 and cannot be accessed by the user. When an employee closes up such as for the night, the secondary shut-off 140 can be employed and the cabinet 12 locked. With the secondary shut-off 140 pinching the flexible milk tube 38 shut, a user cannot dispense liquid from the beverage dispenser 10 regardless of manipulation of the handle 34.

Figure 23:
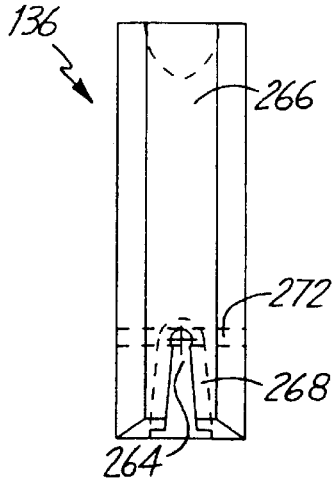
FIG. 23 is a rear elevational view of the pinch plate of FIG. 20.

The pinch plate 136 is best shown in FIGS. 20 and 23. The pinch plate 136 is a generally flat plate which attaches to the push rod 132. Preferably the pinch plate 136 has a detent necked opening 264 toward the bottom of the pinch plate 136. The detent necked opening 264 mates with the groove 258 of the end of the push rod 132, allowing the pinch plate 136 to be snapped onto the push rod 132 with a tactile click. The detent necked opening 264 also allows the pinch plate 136 to pivot somewhat with respect to the push rod 132.

The pinch plate 136 is slightly narrower than at least a portion of the central opening of the top flange 246. This allows the pinch plate 136 to be removed out of the valve body 240 for cleaning, provided the flexible tube 38 is removed out of the valve opening 36 prior to removal of the pinch plate 136. Preferably the central opening of the top flange 246 includes a lip 265 which prevents the pinch plate 136 from being removed from the push rod 132 during removal of the flexible tube 38 from the valve opening 36.

The pinch plate 136 includes a long, lever arm 266 extending upstream from the push rod 132 and a short lever arm 268 extending downstream from the push rod 132. Both the long lever arm 266 and the short lever arm 268 are generally planar, but the plane of the long lever arm 266 is at a slight angle 270 to the plane of the short lever arm 268. The pinch plate 136 also preferably includes a fulcrum 272 on the side toward the flexible tube 38, at the position where the plane of the long lever arm 266 and the plane of the short lever arm 268 intersect.

Figure 26:
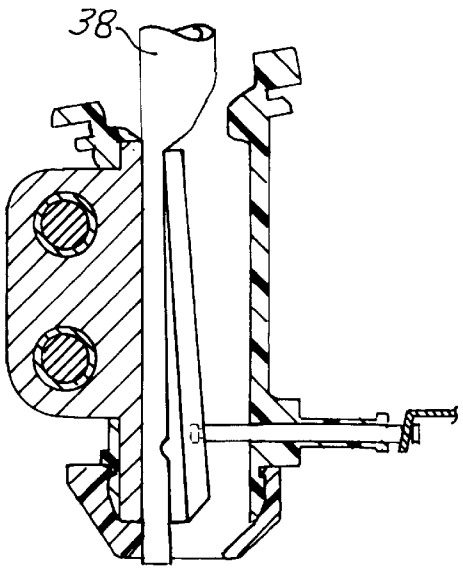
FIGS. 24–26 are partial side cross-sectional views showing operation of the pinch mechanism of FIG. 20.
Figure 25:
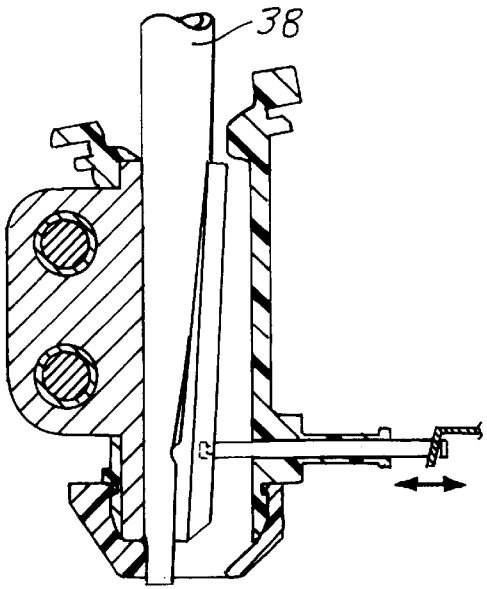
Figure 24:
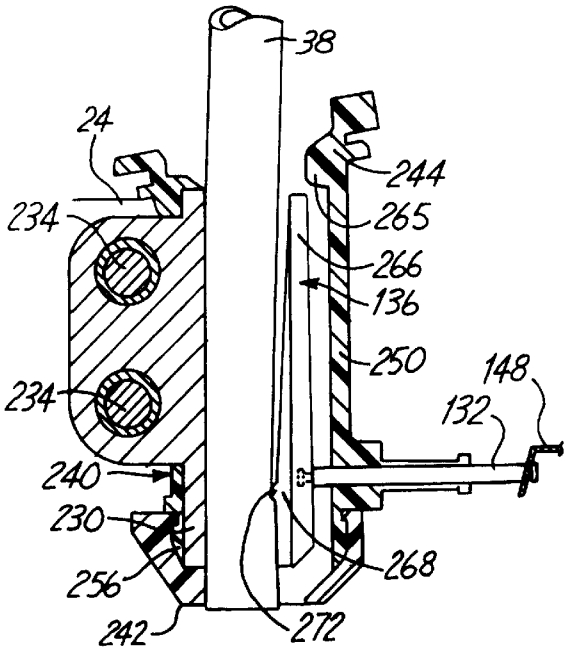

The operation of the preferred pinch plate 136 due to these features will now be described with reference to FIGS. 24–26. FIG. 24 shows the pinch plate 136 in a full flow position. As the user begins to lower the cross bar 46 of the handle 34, the push rod moves forward (to the left in FIG. 25) and, as a result, the pinch plate 136 moves forward into the position shown in FIG. 25. The long lever arm 266 provides a larger moment than the short lever arm 268 and, because the long lever arm 266 is on the upstream side of the push rod 132, the pinch plate 136 tends to pivot as shown in FIG. 25. The first section of the flexible tube 38 to be pinched is thus the lowermost portion in the valve opening 36. The pinch plate 136 is pushed forward by the push arm 148 and push rod 132 such that the short lever arm 268 pinches the bottom of the flexible tube 38 shut.

While the flexible tube 38 is at least partially open, the resistance force provided by the flexible tube 38 is due to bending of the circular tube 38 into a flattened configuration. Once the flexible tube 38 is pushed shut, the resistance force provided by the flexible tube 38 changes from a bending mode to a compression mode. The force required to compress the rubber material of the flexible tube 38 is substantially greater than the force required to bend the flexible tube 38 shut.

Once the bottom of the flexible tube 38 is pinched fully closed, the resistance force of the flexible tube 38 on the short lever arm 268 increases substantially. The resistance force of the flexible tube 38 on the long lever arm 266 (still in a bending mode) does not significantly change at this time. As the push rod 132 continues its motion in pinching the flexible tube 38, the force difference between the short lever arm 268 and the long lever arm 266 tends to pivot the pinch plate 136 back into a fairly upright position shown in FIG. 26, pinching the entire portion of the flexible tube 38 in the valve opening 36 and forcing the column of milk within flexible tube 38 back up into the container 40.

When the handle 34 is entirely released, the push rod 132 moves to its furthest extended position. In this position, the long lever arm 266 is pressed flat against the flexible tube 38. In the fully closed position, the fulcrum 272 forms a location of even tighter pinching. Because the short lever arm 268 of the pinch plate 136 does not extend outward as far as the fulcrum 272, and because it is at a slight angle to the plane of the long lever arm 266, the short lever arm 268 is drawn slightly backward away from the flexible tube 38. This allows the flexible tube 38 to reopen slightly at the very bottom and beyond the fulcrum 272. This slight reopening of the bottom of the flexible tube 38 sucks back into the flexible tube 3S any drops of milk which may otherwise have been retained on the lip of the milk tube 38.

The amount of reopening which occurs at the bottom of the flexible tube 38 during complete closing of the valve 126 is a function of the lengths of the short lever arm 268 and the long lever arm 266, the amount that the fulcrum 272 extends from the remainder of the pinch plate 136 surface, and the location of the push arm 148 connection relative to the fulcrum 272 and to the planes of the short lever arm 268 and the long lever arm 266. Reopening of the bottom of the flexible tube 38 can alternatively be obtained with the short lever arm 268 and the long lever arm 266 extending in the same plane, or with the short lever arm 268 and the long lever arm 266 extending in parallel planes, provided the fulcrum 272 is properly sized and positioned relative to the connection of the push arm 148. Reopening of the bottom of the flexible tube 38 can alternatively be obtained without a fulcrum 272 at all, provided the connection of the push arm 148 is properly positioned relative to the intersection point between the short lever arm 268 and the long lever arm 266.

All of the liquid retained in the flexible tube 38, including any in the reopened bottom portion of the flexible tube 38, is refrigerated. The pinch plate 136 presses the flexible tube 38 against the cooling plate 138, which ensures that none of the liquid in the tube 38 exceeds a temperature of 40° F. Accordingly, no curdling or solidifying of liquid occurs, even during overnight nonuse of the dispensing machine 10. Any bacterial growth in the liquid is substantially retarded due to refrigeration which occurs in the flexible tube 38 due to the cooling plate 138. Use of the beverage dispenser 10 can be resumed the next morning without any residue discharge, and without any substantial bacteria growth due to non-refrigeration.

Although the present invention has been described with reference to preferred embodiments, workers skilled in the art will recognize that changes may be made in form and detail without departing from the spirit and scope of the invention. For instance, one or more inventive portions of the preferred beverage dispenser may be utilized by themselves without incorporating the remaining inventive portions of the preferred beverage dispenser.

What is claimed is:

1. A beverage dispenser for use in dispensing beverage from a beverage container with a flexible discharge tube, the beverage dispenser comprising:

a cabinet defining a chamber for holding the beverage container, the cabinet having a bottom, a top and peripheral side walls, and a door on one of the side walls for insertion and removal of the beverage container, the cabinet having a hole defined therein for receiving the flexible discharge tube therethrough;

a shelf attached to the cabinet adjacent the door, the shelf being pivotable while the door is open between an open position wherein the shelf extends out of the chamber for supporting the beverage container during insertion of the beverage container into the chamber and a closed position allowing closing of the door with the beverage container in the chamber.

2. The beverage dispenser of claim 1, further comprising:

at least three feet attached to the bottom of the cabinet, at least one of the feet extending forward beyond the door for supporting the cabinet without tipping while a full beverage container is resting on the shelf in its open position.

3. The beverage dispenser of claim 1, further comprising:

a case sized to be received inside the cabinet, the case comprising:

a bottom wall;

a plurality of substantially upright peripheral walls extending from the bottom wall and defining a compartment for the beverage container with an open top; and a hand-hold opening defined in each of at least two of the peripheral walls, each hand-hold opening having a hand-hold upper edge for manual lifting of the case with a full beverage container therein, wherein the hand-hold upper edges are disposed at a substantial slant.

4. The beverage dispenser of claim 3, wherein the peripheral walls comprise a front wall, a back wall, and opposing side walls, wherein the hand-hold upper edges are generally straight and extend downwardly and forwardly on the opposing side walls.

5. A case for holding a beverage container for use with a beverage dispenser, the case comprising:

a bottom wall;

a plurality of substantially upright peripheral walls extending from the bottom wall and defining a compartment with an open top for the beverage container; and a hand-hold opening defined in each of at least two of the peripheral walls, each hand-bold opening having a hand-hold upper edge for manual lifting of the case with a full beverage container therein, each hand-hold upper edge having a length sufficient to receive at least four fingers;

wherein the lower extremities of the case define a bottom for placement on a horizontal surface; and wherein the hand-hold upper edges are disposed at a substantial slant to horizontal such that a user's fingers are aligned at a substantial slant to horizontal when manually lifting the case from a horizontal surface through the hand-hold openings.

6. A case for holding a beverage container for use with a beverage dispenser, the case comprising:

a bottom wall;

a plurality of substantially upright peripheral walls extending from the bottom wall, wherein the peripheral walls comprise a front wall, a back wall, and opposing side walls, the peripheral walls defining a compartment for the beverage container with an open top; and a hand-hold opening defined in each of the opposing side walls, each hand-hold opening having a hand-hold upper edge for manual lifting of the case with a full beverage container therein, wherein the hand-hold upper edges are generally straight and extend downwardly and forwardly on the opposing side walls.

7. A case for holding a beverage container for use with a beverage dispenser, the beverage container including a connector with a flexible dispensing tube extending therefrom, the case comprising:

a bottom wall;

a plurality of substantially upright peripheral walls extending from the bottom wall and defining a compartment with an open top for the beverage container; and a dispensing opening channel extending upwardly in a front one of the peripheral walls from the bottom wall to the open top, the dispensing opening channel being sized to slidably receive the connector of the beverage container.

8. The case of claim 7, wherein the bottom wall is slanted such that the lowermost portion of the case is adjacent the dispensing channel opening.

9. The case of claim 7, wherein bottommost portions of the case extend downward beyond the bottom wall such that an entirety of the bottom wall is raised substantially above the bottommost portions of the case.

10. The case of claim 7, wherein the dispensing channel opening is defined by edges of the front wall which taper inwardly and downwardly, thereby orienting the connector centrally in the dispensing opening channel during loading of the beverage container into the case, and thereby permitting manual adjustment of the beverage container through the front wall during use of the beverage dispenser.

11. The case of claim 7, wherein the dispensing opening channel is substantially wider at the top than at the bottom.

12. The case of claim 7, wherein the dispensing channel opening is sized large enough to receive a user's hand.

13. The case of claim 7 further comprising:

a hand-hold opening defined in each of at least two of the peripheral walls, each hand-hold opening having a hand-hold upper edge for manual lifting of the case with a full beverage container therein, each hand-hold upper edge having a length sufficient to receive at least four fingers;

wherein the lower extremities of the case define a bottom for placement on a horizontal surface; and wherein the hand-hold upper edges are disposed at a substantial slant to horizontal, such that a user's fingers are aligned at a substantial slant to horizontal when manually lifting the case from a horizontal surface through the hand-hold openings.

14. The case of claim 13, wherein the peripheral walls comprise a front wall, a back wall, and opposing side walls, wherein the hand-hold upper edges are generally straight and extend downwardly and forwardly on the opposing side walls.

15. A case for holding a beverage container for use with a beverage dispenser, the beverage container including a connector with a flexible dispensing tube extending therefrom the case comprising:

a bottom wall;

plurality of substantially upright peripheral walls extending from the bottom wall and defining a compartment with an open top for the beverage container;

a dispensing opening channel extending upwardly in a front one of the peripheral walls from the bottom wall, the dispensing opening channel being sized to slidably receive the connector of the beverage container; and a tie attached to the front wall on each side of the dispensing opening channel, the tie being structurally rigid, the tie extending at the dispensing opening channel forwardly from a plane of the front wall to permit a connector slidably received in the dispensing opening channel to slide downward past the tie during loading of the beverage container into the case.

16. The case of claim 15, wherein the tie is attached on a lower portion of the front wall above the bottom wall, and wherein the tie has two attachment flanges and two guide walls disposed at an angle to the attachment flanges and connected in a front center corner to guide the flexible dispensing tube to a raised, central position during loading of the beverage container into the case.

17. A case for holding a beverage container for use with a beverage dispenser, the beverage container including a connector with a flexible dispensing tube extending therefrom, the case comprising:

a bottom wall;

a plurality of substantially upright peripheral walls extending from the bottom wall and defining a compartment with an open top for the beverage container, wherein a front one of the peripheral walls is disposed at an angle to the vertical such that the compartment is deeper at the top than at the bottom; and a dispensing opening channel extending upwardly in a front one of the peripheral walls from the bottom wall, the dispensing opening channel being sized to slidably receive the connector of the beverage container.

18. A case for holding a beverage container for use with a beverage dispenser, the beverage container including a connector with a flexible dispensing tube extending therefrom, the case comprising:

bottom wall;

a plurality of substantially upright peripheral walls extending from the bottom wall and defining a compartment with an open top for the beverage container, wherein the bottom wall and a front one of the peripheral walls meet to form a bottom corner having a curvature; and a dispensing opening channel extending upwardly in a front one of the peripheral walls from the bottom wall, the dispensing opening channel being sized to slidably receive the connector of the beverage container and wherein the dispensing opening channel extends into at least part of the curvature.

* * * * *

UNITED STATES PATENT AND TRADEMARK OFFICE

CERTIFICATE OF CORRECTION

PATENT NO. : 6,095,372

DATED : AUGUST 1, 2000

INVENTOR(S) : STEVEN T. DORSEY ET AL.

It is certified that error appears in the above-identified patent and that said Letters Patent is hereby corrected as shown below:

Col. 1, line 30, delete "baas", insert --bags--

Col. 1, line 55, delete "ho", insert --who--

Col. 3, line 21, delete "alone", insert --along--

Col. 4, line 11, delete "mill", insert --milk--

Col. 4, line 50, delete "While", insert --while--

Col. 5, line 64, delete "bepositioned", insert --be positioned--

Col. 6, line 20, delete "While", insert --while--

Col. 6, line 27, delete "and or", insert --and/or--

Col. 6, line 48, delete "shows", insert --shown--

Col. 6, line 57, after "cabinet", insert --12--

Col. 6, line 65, delete "7S", insert --78--

Col. 7, line 16, delete "aliens", insert --aligns--

Col. 7, line 61, after "FIG. 11", insert --)--

Col. 9, line 6, delete "linking", insert --kinking--

Col. 9, line 27, delete "mill", insert --milk--

Col. 10, line 42, delete "With", insert --with--

Col. 10, line 44, delete "baa", insert --bag--

UNITED STATES PATENT AND TRADEMARK OFFICE

CERTIFICATE OF CORRECTION

PATENT NO. : 6,095,372

DATED : AUGUST 1, 2000

INVENTOR(S) : STEVEN T. DORSEY ET AL.

It is certified that error appears in the above-identified patent and that said Letters Patent is hereby corrected as shown below:

Col. 15, line 43, delete "frill", insert --full--

Col. 16, line 7, delete "treat", insert --great--

Col. 16, line 43, delete "forte", insert --force--

Col. 17, line 41, delete "The", insert --the--

Col. 17, line 48, delete "Movement", insert --movement--

Col. 18, line 9, delete "229", insert --222--

Col. 18, line 21, delete "When", insert --when--

Col. 18, line 30, delete "3S", insert --38--

Col. 20, line 12, delete "1S", insert --18--

Col. 20, line 20, delete "shoe n", insert --shown--

Col. 21, line 51, delete "bode", insert --body--

Col. 23, line 32, delete "3S', insert --38--

Col. 26, line 9, before "plurality", insert -- a --

UNITED STATES PATENT AND TRADEMARK OFFICE

CERTIFICATE OF CORRECTION

PATENT NO. : 6,095,372
DATED : August 1, 2000
INVENTOR(S) : Steven T. Dorsey, et al.

It is certified that error appears in the above-identified patent and that said Letters Patent is hereby corrected as shown below:

Col. 26, line 49, before "bottom", insert --a--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*